US009604807B2

(12) United States Patent
Etsuki

(10) Patent No.: US 9,604,807 B2
(45) Date of Patent: Mar. 28, 2017

(54) SHEET TRANSFER DEVICE

(71) Applicant: RISO KAGAKU CORPORATION, Tokyo (JP)

(72) Inventor: Ryohei Etsuki, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/934,748

(22) Filed: Nov. 6, 2015

(65) Prior Publication Data

US 2016/0145064 A1 May 26, 2016

(30) Foreign Application Priority Data

Nov. 26, 2014 (JP) ..... 2014-238670

(51) Int. Cl.
*B65H 5/06* (2006.01)
*B65H 5/38* (2006.01)

(52) U.S. Cl.
CPC ..... *B65H 5/38* (2013.01); *B65H 5/062* (2013.01); *B65H 2402/31* (2013.01); *B65H 2402/32* (2013.01); *B65H 2402/441* (2013.01); *B65H 2402/61* (2013.01); *B65H 2404/611* (2013.01); *B65H 2801/06* (2013.01)

(58) Field of Classification Search
CPC ..... B65H 5/062; B65H 5/38; B65H 2601/11; B65H 2402/441
See application file for complete search history.

(56) References Cited

U.S. PATENT DOCUMENTS 6,799,008 B1 * 9/2004 Lim ..... G03G 15/6573 271/264
7,374,165 B2 * 5/2008 Agata ..... B65H 5/062 271/248
8,454,014 B2 * 6/2013 Kotera ..... B65H 5/062 271/272
9,272,865 B2 * 3/2016 Tsumura ..... B65H 5/062

FOREIGN PATENT DOCUMENTS

JP 2009-31422 2/2009

* cited by examiner

*Primary Examiner* — Luis A Gonzalez
(74) *Attorney, Agent, or Firm* — Greenblum & Bernstein, P.L.C.

(57) ABSTRACT

A first sheet transfer guide plate includes a first divided sheet guide plate and a second divided sheet guide plate separably connected to each other. The first divided sheet guide plate is capable of being drawn out by being moved relative to the second divided sheet guide plate in a sheet width direction orthogonal to a sheet transfer direction. The second divided sheet guide plate with the first divided sheet guide plate drawn out is turnable about a turning shaft in a direction away from a second sheet transfer guide plate. The turning shaft is arranged parallel to the sheet transfer direction and arranged in a rear end of the second divided sheet guide plate. The rear end is located opposite to a side toward which the first divided sheet guide plate is drawn out.

5 Claims, 17 Drawing Sheets

SHEET TRANSFER DEVICE

CROSS REFERENCE TO RELATED APPLICATION

This application is based upon and claims the benefit of priority from the prior Japanese Patent Application No. 2014-238670, filed on Nov. 26, 2014, the entire contents of which are incorporated herein by reference.

BACKGROUND

1. Technical Field

The disclosure relates to a sheet transfer device which allows a sheet, if jammed across the sheet transfer device and its adjacent sheet transfer device arranged along a sheet transfer route in an image forming apparatus while being transferred along the sheet transfer route, to be easily taken out from the devices without leaving the jammed sheet in the devices.

2. Related Art

Generally, the sheet transfer device configured to transfer sheets is applied to an image forming apparatus such as a printer configured to print images and characters on sheets and a photocopier configured to duplicate images and characters on sheets.

Japanese Unexamined Patent Application Publication No. 2009-31422 discloses such an image forming apparatus to which the sheet transfer device is applied. In this image forming apparatus, when paper jam occurs and a jammed sheet exists across a main body and a drawer unit, the jammed sheet can be automatically prevented from tearing.

Although illustration is omitted herein, the aforementioned image forming apparatus includes units for sheet transfer (for example, a sheet transfer unit and a duplex printing unit) as drawer units in various portions of the apparatus such that the units can be drawn out in a substantially horizontal direction to protrude from the front side of the main body.

For example, the aforementioned sheet transfer unit includes: a base portion engaging with rails in the main body and configured to be capable of being drawn out in a front direction orthogonal to a sheet transfer direction; and a sheet guide member attached onto the base portion and configured to be openable and closeable by turning about a supporting shaft extending in a sheet width direction orthogonal to the sheet transfer direction.

Further, a sheet transfer route for transferring sheets is formed between the base portion and the sheet guide member and pairs of upper and lower sheet transfer rollers are arranged along the sheet transfer route.

When sheet jam occurs, a controller stops all of the sheets being transferred in the main body. In addition, if the sheet is stopped to exist across the main body and the drawer unit configured as described above, the controller moves the stopped sheet to cause the sheet to completely enter the drawer unit or the main body.

For example, Japanese Unexamined Patent Application Publication No. 2009-31422 states that a user can take out a jammed sheet from the sheet transfer route by: drawing out the sheet transfer unit from the main body: and then opening the sheet guide member upward from the base portion to expose the sheet transfer route.

SUMMARY

As mentioned above, Japanese Unexamined Patent Application Publication No. 2009-31422 states that, in the image forming apparatus described therein, the controller moves the sheet to cause the sheet to completely enter the drawer unit or the main body when the sheet stops in such a way as to exist across the drawer unit and the main body in occurrence of sheet jam. However, if the jammed sheet existing across the drawer unit and the main body is moved to completely enter the drawer unit or the main body, the jamming state of the sheet may become worse.

In the case of drawing out the drawer unit to take out the jammed sheet, the drawer unit needs to be fully drawn out to open the sheet guide member by turning the sheet guide member about the supporting shaft extending in the sheet width direction orthogonal to the sheet transfer direction. Accordingly, the jammed sheet may be difficult to take out if the unit is heavy.

Moreover, when the drawer unit is drawn out substantially horizontally to a position in front of the apparatus to take out the jammed sheet, the drawn-out drawer unit inevitably occupies as large an area as an exterior size of the drawer unit. Hence, this occupied area is large.

An object of the disclosure is to provide a sheet transfer device which allows a sheet, if jammed across the sheet transfer device and its adjacent sheet transfer device arranged along a sheet transfer route in an image forming apparatus while being transferred along the sheet transfer route, to be easily taken out from the devices without leaving any part of the jammed sheet in the devices and which allows the sheet to be easily taken out while being designed such that a member arranged in the sheet transfer device occupies only a small area when being drawn out to protrude from the device in the take out of the jammed sheet.

A sheet transfer device in accordance with some embodiments includes: a sheet transfer unit including a plurality of pairs of sheet transfer rollers arranged along a sheet transfer route and configured to transfer a sheet in a sheet transfer direction while nipping the sheet between each of the pairs of sheet transfer rollers; and a first sheet transfer guide plate and a second sheet transfer guide plate arranged along the sheet transfer route to face each other and configured to guide the sheet transferred by the sheet transfer unit. The first sheet transfer guide plate includes a first divided sheet guide plate and a second divided sheet guide plate separably connected to each other. The first divided sheet guide plate is capable of being drawn out by being moved relative to the second divided sheet guide plate in a sheet width direction orthogonal to the sheet transfer direction. The second divided sheet guide plate with the first divided sheet guide plate drawn out is turnable about a turning shaft in a direction away from the second sheet transfer guide plate. The turning shaft is arranged parallel to the sheet transfer direction and arranged in a rear end of the second divided sheet guide plate. The rear end is located opposite to a side toward which the first divided sheet guide plate is drawn out.

In configuration described above, by drawing out the first divided sheet guide plate from the inside of the device and turning and opening the second divided sheet guide plate in the direction away from the other sheet transfer guide plate, the jammed sheet left on the second divided sheet guide plate side can be easily taken out with the first divided sheet guide plate occupying only a small area in the draw-out.

The first divided sheet guide plate may include a push-in prohibiting portion configured to prohibit a push-in operation of the first divided sheet guide plate with the second divided sheet guide plate turned in the direction away from the second sheet transfer guide plate, and the push-in prohibiting portion may overlap at least a part of the second divided sheet guide plate in a direction of gravity upon the first divided sheet guide plate being pushed with the second divided sheet guide plate not turned in the direction away from the second sheet transfer guide plate. Alternatively, the second divided sheet guide plate may include a push-in prohibiting portion configured to prohibit a push-in operation of the first divided sheet guide plate with the second divided sheet guide plate turned in the direction away from the second sheet transfer guide plate, and the push-in prohibiting portion may overlap at least a part of the first divided sheet guide plate in a direction of gravity upon the first divided sheet guide plate being pushed with the second divided sheet guide plate not turned in the direction away from the second sheet transfer guide plate.

In the configuration described above, when the user carelessly or intentionally pushes the first divided sheet guide plate in the opposite direction to the draw-out direction with the second divided sheet guide plate being turned in the direction away from the other sheet transfer guide plate, the second divided sheet guide plate rides on and collides with the first divided sheet guide plate due to the presence of the push-in prohibiting portion formed in the first divided sheet guide plate or the second divided sheet guide plate. Accordingly, the push-in operation of the first divided sheet guide plate can be prohibited and the second divided sheet guide plate can be prevented from being housed in the device.

Accordingly, an abnormal state where the second divided sheet guide plate is placed on the first divided sheet guide plate in an overlapping manner does not occur when the first divided sheet guide plate is pushed toward the proper position in the device with the second divided sheet guide plate being open, and the safety and reliability of the device can be improved.

DETAILED DESCRIPTION

Figure 1:
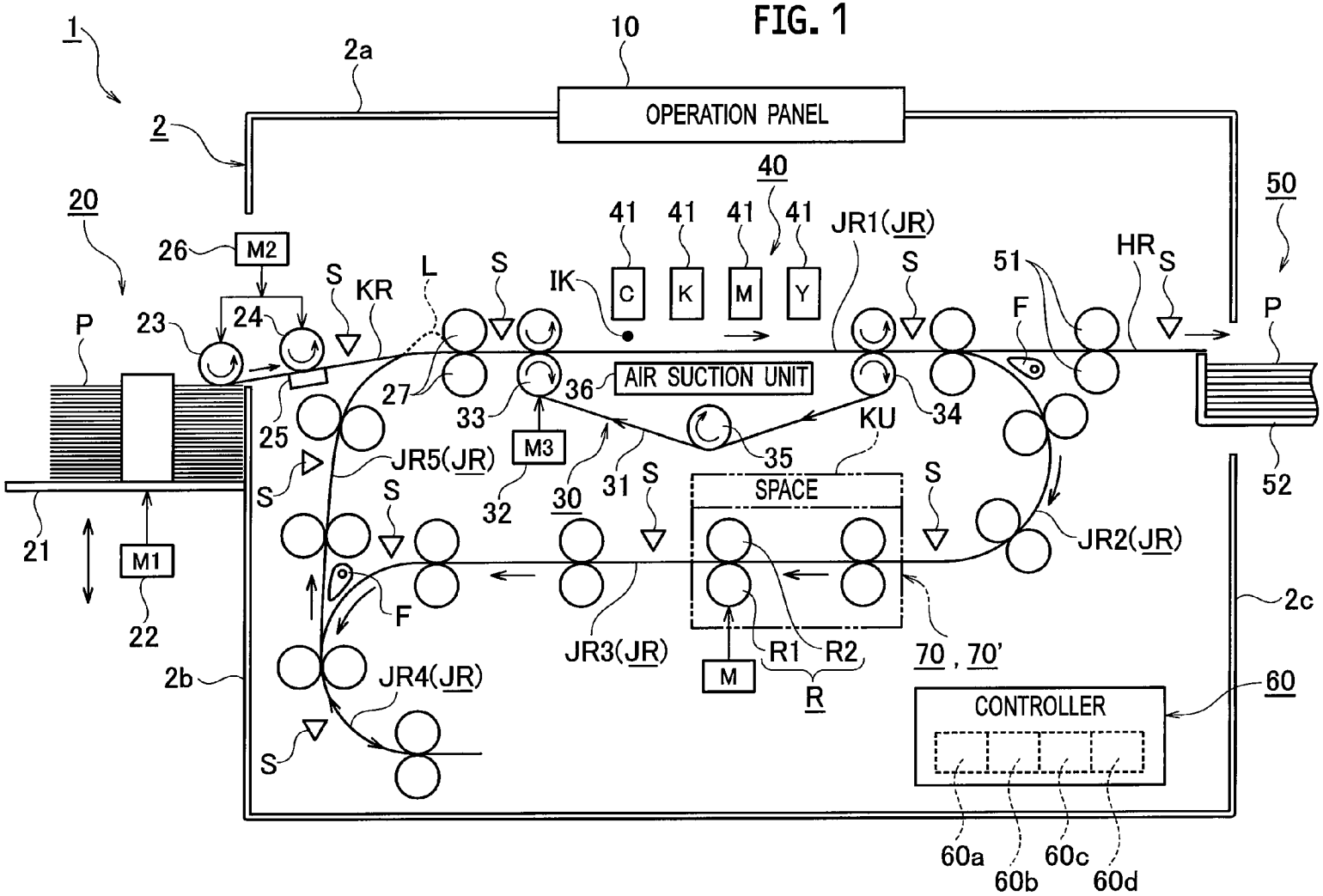
FIG. 1 is a configuration diagram showing an overall configuration of an inkjet printer to which sheet transfer devices of embodiments are applied.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Sheet transfer devices 70 and 70' of first and second embodiments are described below in detail with reference to FIGS. 1 to 17B. In the drawings, a transfer direction of sheets P, a width direction of the sheets P, a draw-out direction of a first divided sheet guide plates 82 and 82', and an opposite direction to the draw-out direction are denoted by TD, WD, DD, and ODD, respectively. Moreover, in the drawings, an upstream side, a downstream side, a front side, and a rear side are denoted by US, DS, FT, and RR, respectively.

The sheet transfer devices 70 and 70' of the first and second embodiments are applied to an image forming apparatus such as a printer configured to print images and characters on sheets and a photocopier configured to duplicate images and characters on sheets. The sheet transfer devices are unitized and arranged along a sheet transfer route for transferring the sheets in the image forming apparatus.

Each of the aforementioned sheet transfer devices 70 and 70' is configured such that, when sheet jam occurs across the sheet transfer device 70 or 70' and its adjacent sheet transfer device 70 or 70' arranged along the sheet transfer route while a sheet is transferred along the sheet transfer route in the image forming apparatus, a jammed sheet can be easily taken out from the devices without leaving any part of the jammed sheet in the devices.

Before giving description of the sheet transfer devices 70 and 70' of the first and second embodiments, by using FIG. 1, an inkjet printer 1 is described as an example of the image forming apparatus to which the sheet transfer devices 70 and 70' are applied.

Inkjet Printer

FIG. 1 shows an inkjet printer 1 to which the sheet transfer device 70 of the first embodiment or the sheet transfer device 70' of the seconded embodiment is applied.

As shown in FIG. 1, the inkjet printer 1 is capable of performing simplex printing or duplex printing on the sheets P by an inkjet method and includes: an operation panel 10 used to operate the entire inkjet printer 1; a paper feeder 20 configured to feed the sheets P one by one; a belt platen unit 30 rotatably arranged downstream of the paper feeder 20 in a sheet transfer direction; a printing unit 40 provided with multiple line inkjet heads 41 which face the belt platen unit 30 and which eject multiple color inks IK; a paper discharge unit 50 configured to discharge the printed sheets P subjected to printing in the printing unit 40; and a controller 60 configured to control the entire inkjet printer 1.

The sheet transfer route through which the sheets P are transferred at a constant speed in the inkjet printer 1 includes: a paper feed transfer route KR which extends from the paper feeder 20 to the belt platen unit 30 and the printing unit 40; a circulation transfer route JR which is connected to the paper feed transfer route KR and through which the sheets P are circulated to pass the belt platen unit 30 and the printing unit 40 to enable duplex printing on the sheets P; and a paper discharge transfer route HR which branches off from the middle of the circulation transfer route JR and extends to the paper discharge unit 50.

In the aforementioned circulation transfer route JR, a printing transfer route JR1, a first vertical transfer route JR2, a horizontal transfer route JR3, a switchback transfer route JR4, and a second vertical transfer route JR5 are connected to one another in this order. The printing transfer route JR1 extends along the belt platen unit 30 and the printing unit 40, the first vertical transfer route JR2 allows the sheets P printed on one side to be transferred below the belt platen unit 30, the horizontal transfer route JR3 allows the sheets P printed on one side to be transferred substantially horizontally from a position below the belt platen unit 30 toward the upstream side in the sheet transfer direction, the switchback transfer route JR4 allows the sheets P printed on one side to be transferred such that the sheets P are switched back and a leading end of each sheet P is changed from a leading edge portion to a trailing edge portion, and the second vertical transfer route JR5 allows the sheets P switched back and printed on one side to be transferred upward to the belt platen unit 30 and the printing unit 40 again with the sheets P being turned over.

The sheet transfer device 70 of the first embodiment or the sheet transfer device 70' of the second embodiment is unitized and arranged along, for example, the horizontal transfer route JR3 in the circulation transfer route JR. The sheet transfer devices 70 and 70' will be described in detail later.

Multiple sheet transfer roller pairs R configured to transfer the sheets P at the constant speed are provided in the sheet transfer route at such intervals that the sheet transfer roller pairs R can transfer a sheet of the smallest size out of multiple types of the sheets P different in size. In this configuration, each of the sheet transfer roller pairs R is formed of a pair of a drive roller R1 coupled to and rotated by a geared motor M which is a drive source and a driven roller R2 driven by coming into pressure contact with the drive roller R1.

Multiple sheet sensors S configured to detect passage of each sheet P are arranged in the sheet transfer route at appropriate positions. The multiple sheet sensors S can detect occurrence of sheet jam via the controller 60 by using light reflective sensors or light transmission sensors, when the sheet P transferred at the constant speed does not reach a position of each sensor at a preset time.

Flippers F for switching a transfer direction of the sheets P are turnably arranged between the paper discharge transfer route HR and the first vertical transfer route JR2 in the circulation transfer route JR and between the switchback transfer route JR4 and the second vertical transfer route JR5 in the circulation transfer route JR.

Units of the inkjet printer 1 are specifically described one by one. A case 2 forming an exterior of the inkjet printer 1 is formed in a box shape.

The operation panel 10 is arranged on a top surface 2*a* of the case 2. Although detailed illustration is omitted herein, the operation panel 10 is provided with a simplex/duplex printing selection key, a start key, a stop key, numeric keys, a copy number setting key, a warning displaying portion, a liquid crystal display panel, and the like.

The paper feeder 20 is provided with a paper feed tray 21 which can be moved upward and downward along an outer side of a left plate 2*b* of the case 2 by a first geared motor 22.

Sheets P of one type out of multiple types of sheets P ranging from the sheet P of the smallest size (for example, postcard size) to the sheet P of the largest size (for example, A3 size) are stacked on the paper feed tray 21, and the sheet size of the sheets P of the one type is automatically detected in the paper feed tray 21 by a not-illustrated sheet size detector.

When the paper feed tray 21 moves upward and the sheet P in the top layer among the unprinted sheets P stacked on the paper feed tray 21 reaches a paper feed position, a paper feed roller 23 comes into pressure contact with the sheet P in the top layer while rotating and feeds this sheet P.

Thereafter, the thus-fed sheets P are separated from each other into single sheets when being transferred and held between a separation roller 24 and a friction pad 25 which are arranged downstream of the paper feed roller 23.

In this case, the paper feed roller 23 and the separation roller 24 are driven by a second geared motor 26, which is a common drive source, to be rotated clockwise.

Furthermore, a leading edge portion of each of the fed sheets P in the transfer direction abuts on a registration roller pair 27 which is not rotating and a loop L illustrated by a dotted line is thereby formed. Due to this loop L, a leading edge position of the sheet P is aligned with the registration roller pair 27.

Thereafter, the registration roller pair 27 starts to rotate and thereby transfers the sheet P to the belt platen unit 30 and the printing unit 40 while correcting skewing of the sheet P and adjusting a transfer timing of the sheet P.

The paper feed roller 23, the separation roller 24, and the friction pad 25 which are described above form a first paper feeder which feeds the sheets P stacked on the paper feed tray 21 one by one. Meanwhile, the registration roller pair 27 described above forms a second paper feeder which transfers each of the sheets P fed by the first paper feeder downstream while correcting the skewing of the sheet P and adjusting the transfer timing of the sheet P.

Next, in the aforementioned belt platen unit 30, a belt platen 31 having multiple air suction holes (not illustrated) and formed in a belt shape is endlessly wound around a drive pulley 33 and a driven pulley 34 with an intermediate pulley 35 arranged therebetween, the drive pulley 33 being driven by a third geared motor 32 to rotate at a constant transfer speed. Each of the sheets P transferred onto the belt platen 31 is transferred in the direction of the arrow by the belt platen 31 while being suctioned by an air suction unit 36.

The aforementioned printing unit 40 is arranged above the belt platen unit 30 to face the belt platen unit 30 with a small gap provided therebetween, and is disposed in a substantially-center portion of the case 2.

In the printing unit 40, the multiple line inkjet heads 41 corresponding to the inks IK of multiple colors are fixedly arranged such that a C (cyan) inkjet head, a K (black) inkjet head, a M (magenta) inkjet head, and a Y (yellow) inkjet head are arranged in this order from the upstream side to the downstream side in the transfer direction of the sheets P.

The multiple line inkjet heads 41 print a color image on each sheet P while the sheet P fixed onto the belt platen 31 by air suction is transferred in the direction of the arrow by the rotation of the belt platen 31.

In this case, when the color image is printed on one side of the sheet P, the sheet P is made to pass through the printing transfer route JR1 in the circulation transfer route JR once and is then discharged to the paper discharge unit 50 to be described later. Meanwhile, when the color image is printed on both sides of the sheet P, the sheet P printed on one side is turned over and made to path through the printing transfer route JR1 twice in the circulation transfer route JR and is then discharged to the paper discharge unit 50 to be described later.

The aforementioned paper discharge unit 50 is arranged downstream of the belt platen unit 30 and the printing unit 40, on a right plate 2*c* side of the case 2. In the paper discharge unit 50, the sheets P printed on one side or printed on both sides are discharged onto a paper receiving tray 52 by a discharge roller pair 51.

The controller 60 configured to control the entire inkjet printer 1 is arranged at an appropriate position in the case 2. The controller 60 includes therein: a CPU 60*a* configured to perform calculation processing and determination processing; a ROM 60*b* configured to store an operation program of the inkjet printer 1 and the like; a RAM 60*c* configured to temporarily store various types of information which can be changed in the inkjet printer 1; and a timer 60*d* configured to measure the time at which the sheet P passes each sheet sensor S.

First Embodiment

A configuration of the sheet transfer device 70 in the first embodiment is described by using aforementioned FIG. 1 and newly-presented FIGS. 2 to 7.

Figure 2:
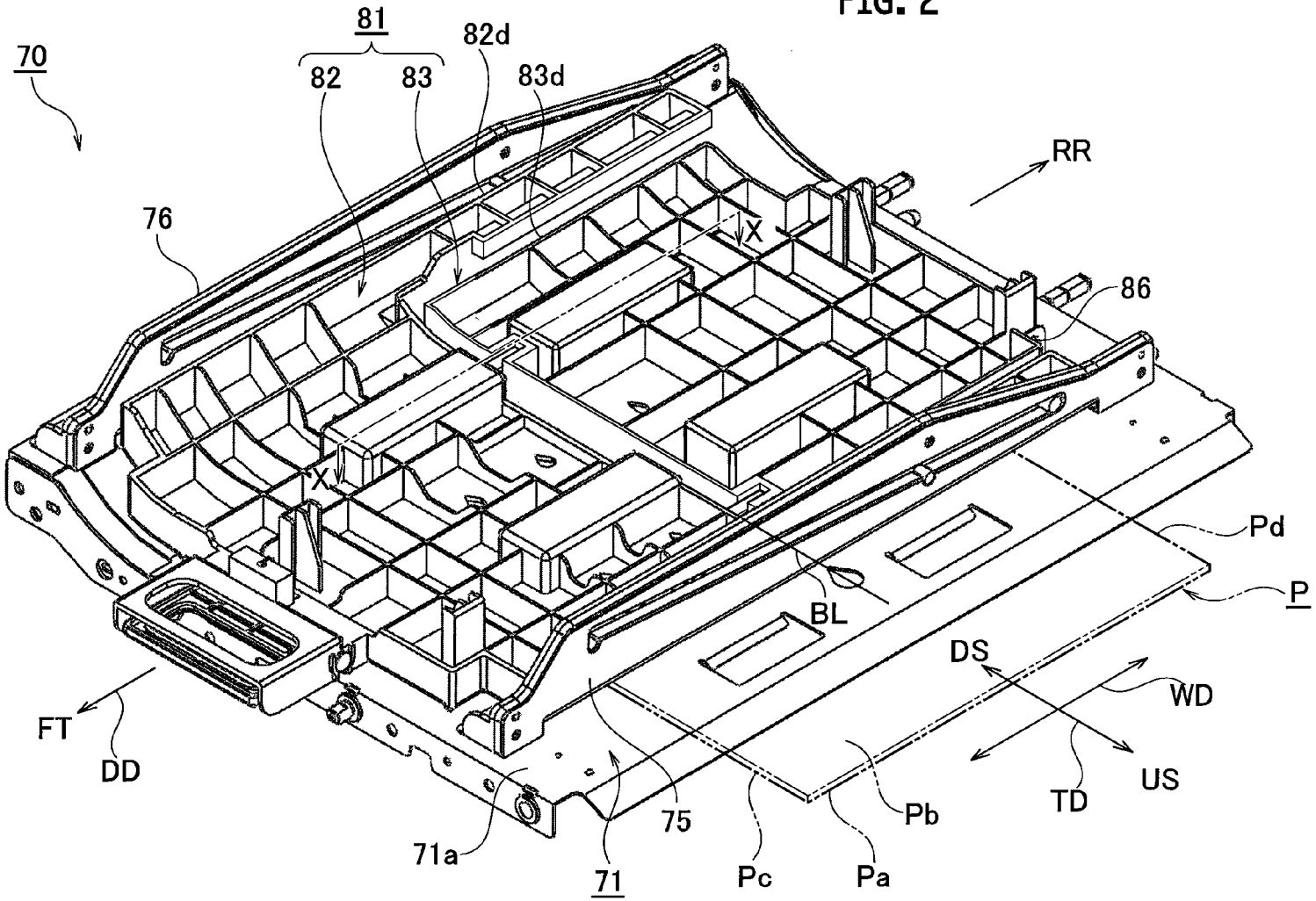
FIG. 2 is a perspective view showing a sheet transfer device of the first embodiment.
Figure 3:
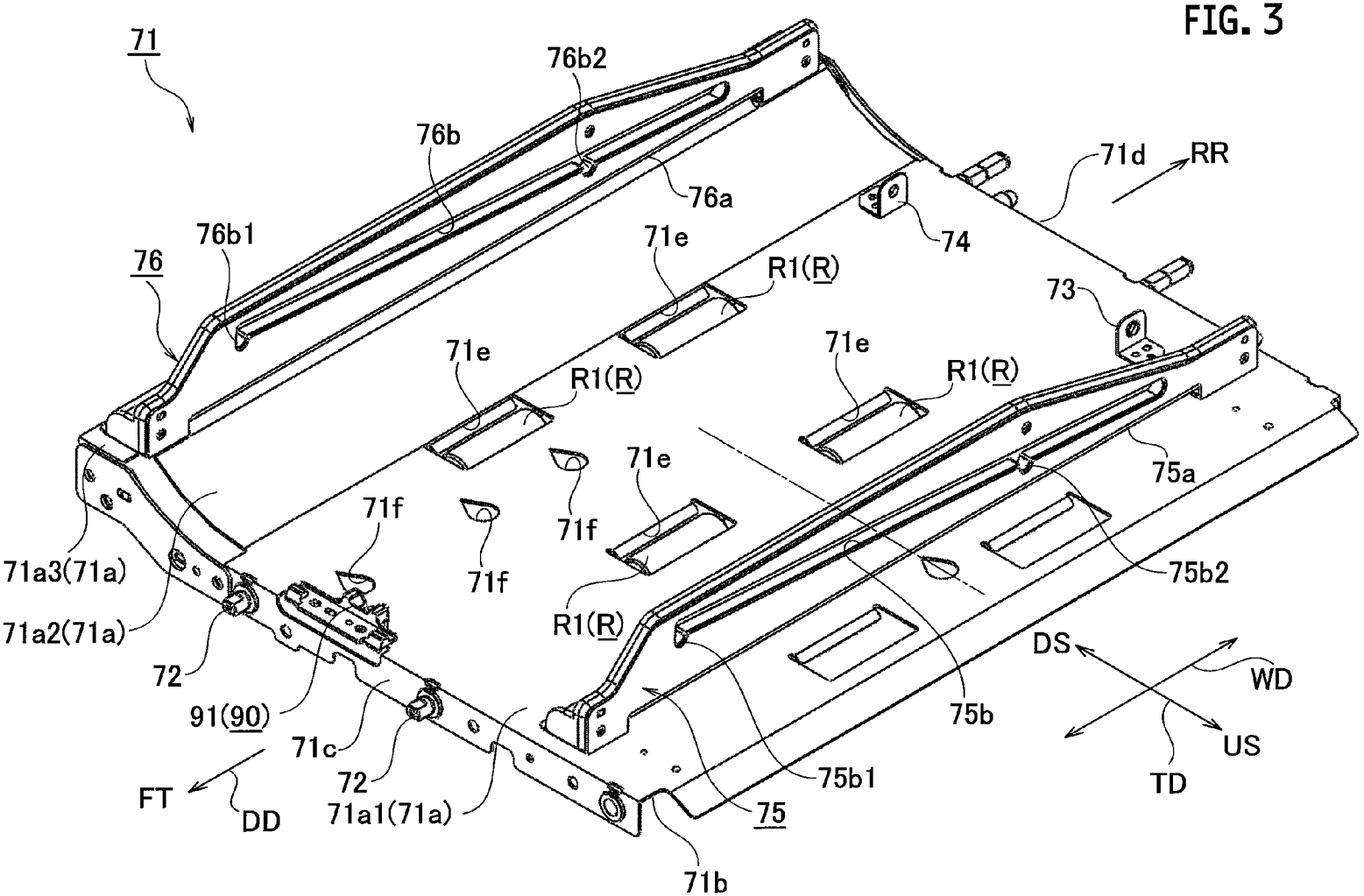
FIG. 3 is a perspective view showing a drive-side sheet transfer guide plate shown in FIG. 2 in the sheet transfer device of the first embodiment.
Figure 4:
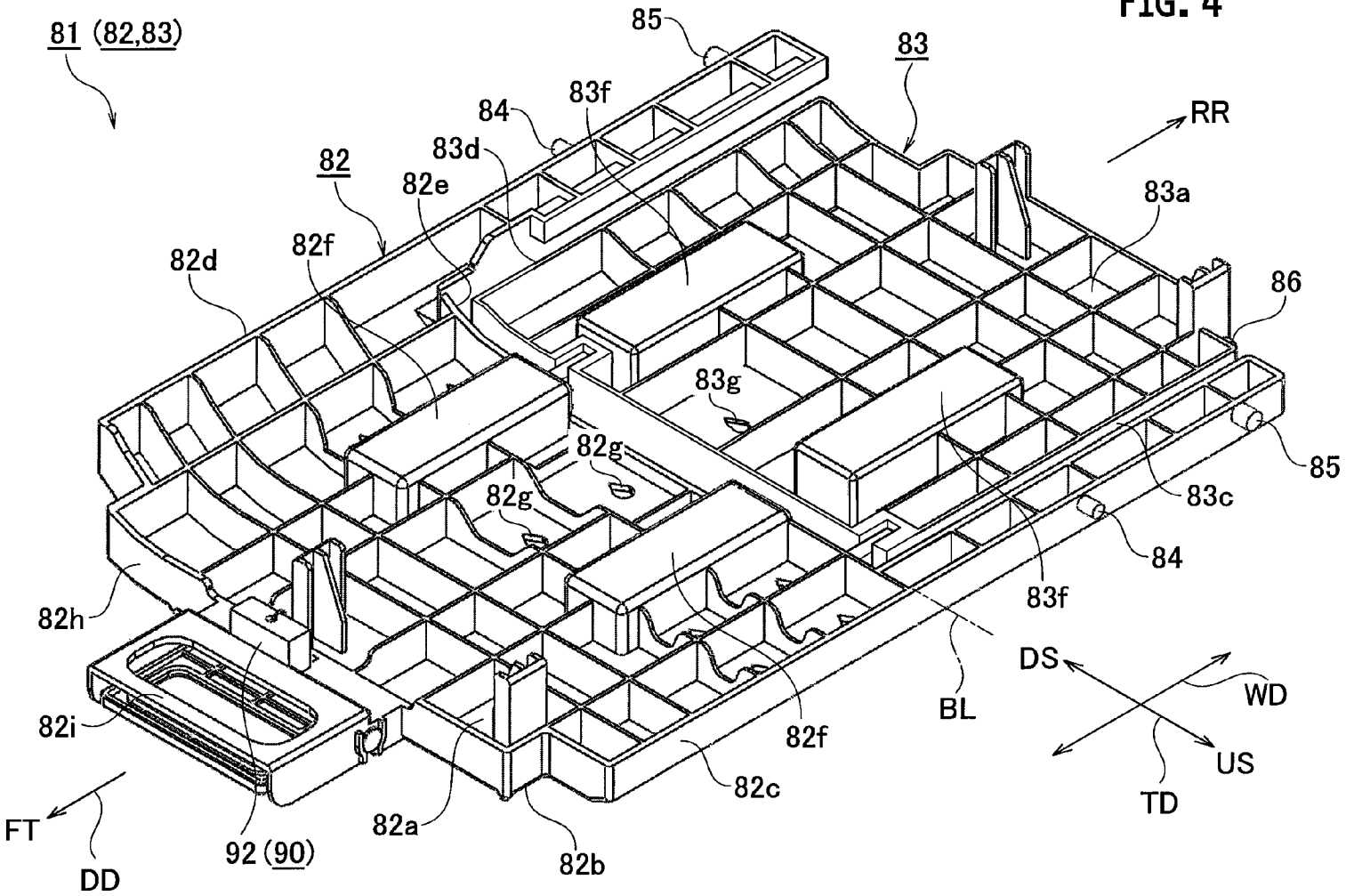
FIG. 4 is a perspective view showing a driven-side sheet transfer guide plate shown in FIG. 2 in the sheet transfer device of the first embodiment.
Figure 5:
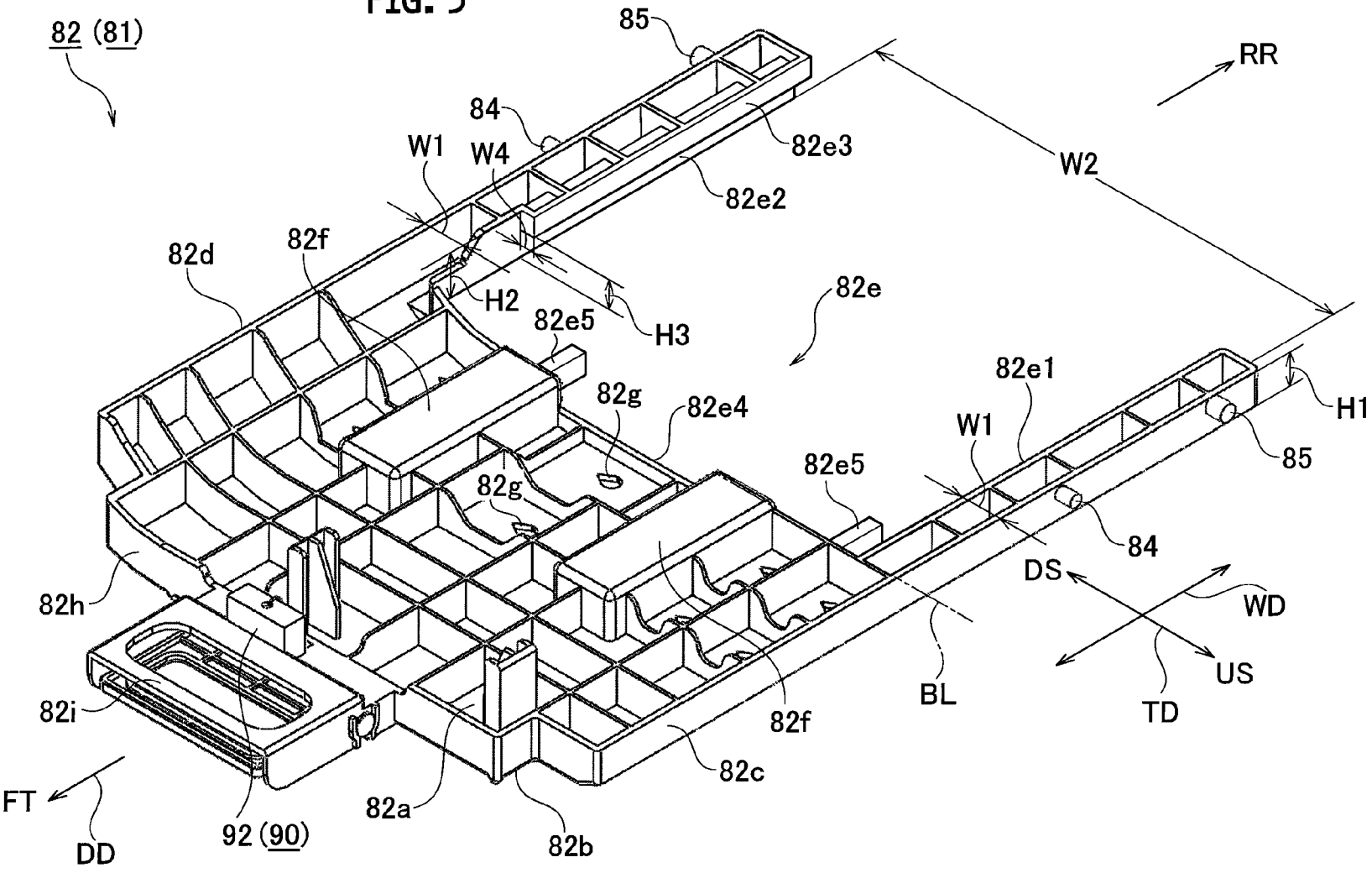
FIG. 5 is a perspective view showing a first divided sheet guide plate of the driven-side sheet transfer guide plate shown in FIGS. 2 and 4 in the sheet transfer device of the first embodiment.
Figure 6:
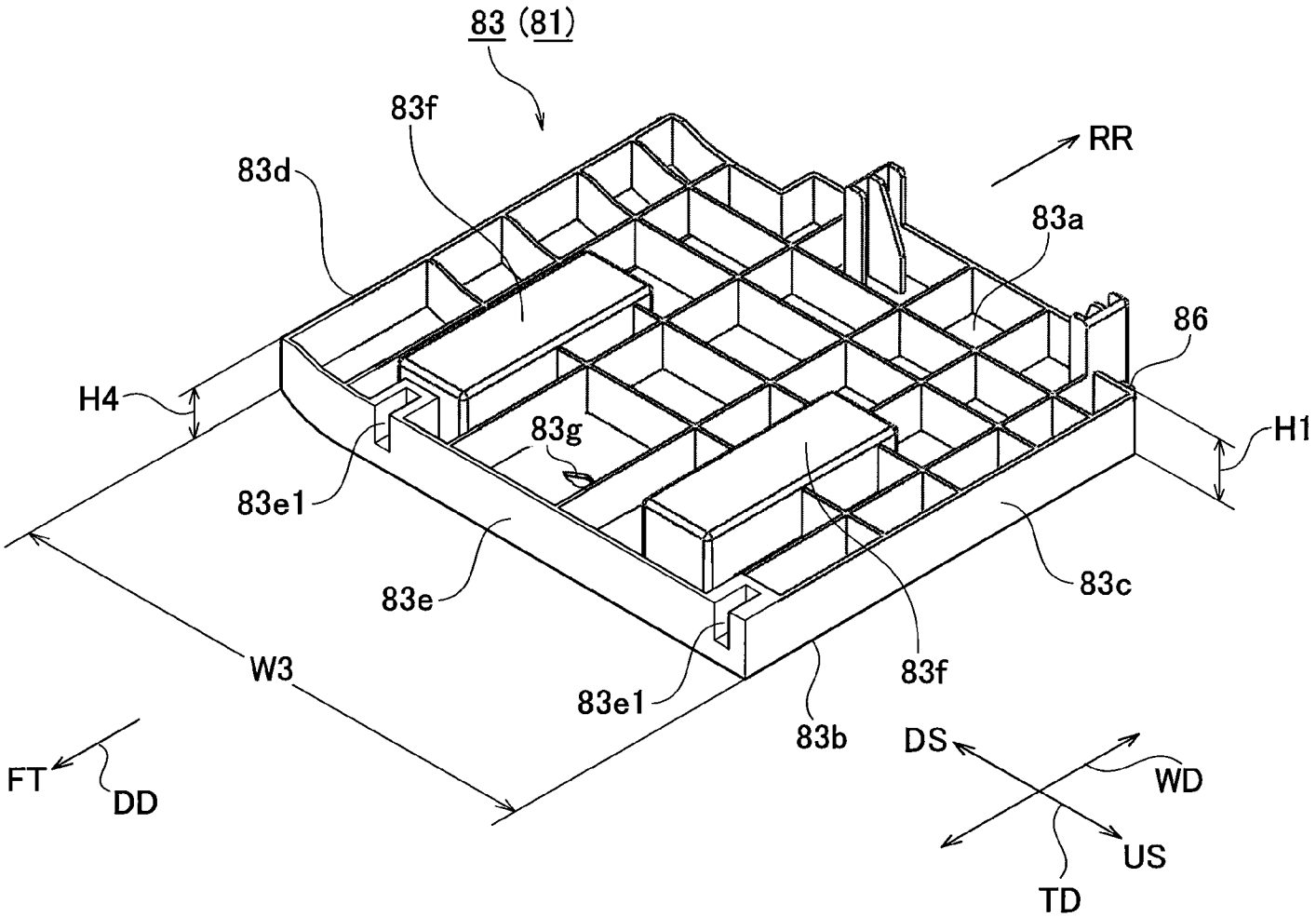
FIG. 6 is a perspective view showing a second divided sheet guide plate of the driven-side sheet transfer guide plate shown in FIGS. 2 and 4 in the sheet transfer device of the first embodiment.
Figure 7:
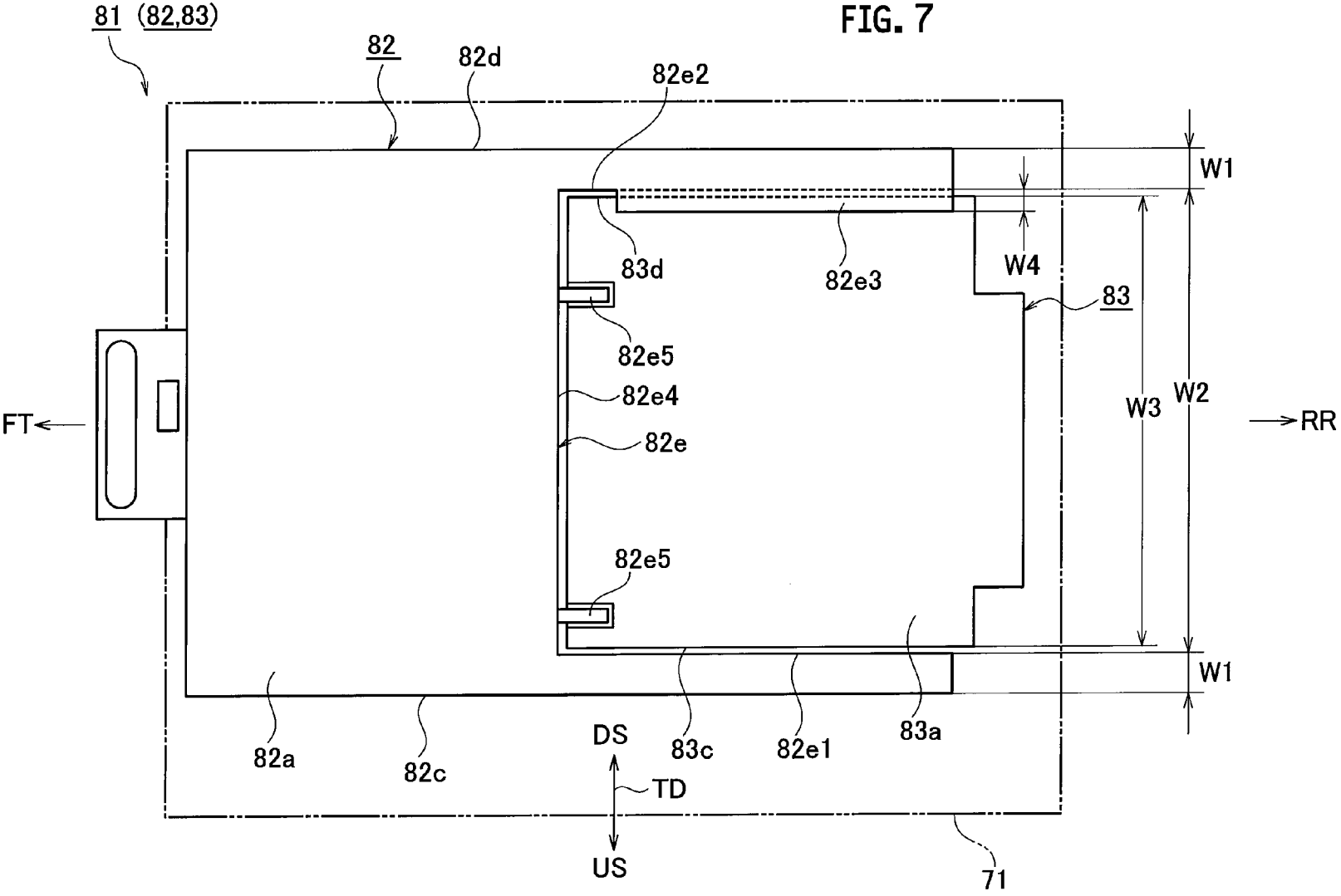
FIG. 7 is a plan view schematically showing a state where a push-in prohibiting portion connected to an upper portion of a downstream wing portion of the first divided sheet guide plate overlaps a downstream outer surface of the second divided sheet guide plate in the sheet transfer device of the first embodiment.

FIG. 2 is a perspective view of the sheet transfer device 70. FIG. 3 is a perspective view of a drive-side sheet transfer guide plate 71 (second sheet transfer guide plate) shown in FIG. 2. FIG. 4 is a perspective view of a driven-side sheet transfer guide plate 81 (82 and 83) (first sheet transfer guide plate) shown in FIG. 2. FIG. 5 is a perspective view of a first divided sheet guide plate 82 of the driven-side sheet transfer guide plate 81. FIG. 6 is a perspective view of a second divided sheet guide plate 83 of the driven-side sheet transfer guide plate 81. FIG. 7 is a plan view schematically showing a state where a push-in prohibiting portion 82*e*3 connected to an upper portion of a downstream wing portion 82*e*2 of the first divided sheet guide plate 82 overlaps a downstream outer surface 83*d* of the second divided sheet guide plate 83.

As shown in FIG. 1, the sheet transfer device 70 is arranged along the sheet transfer route in the inkjet printer 1. For example, the sheet transfer device 70 is unitized and arranged along the horizontal transfer route JR3 in the circulation transfer route JR forming part of the sheet transfer route.

As described above, the horizontal transfer route JR3 in the circulation transfer route JR are provided with the multiple sheet transfer roller pairs R each formed of the pair of the drive roller R1 and the driven roller R2, the drive roller R1 being coupled to the geared motor M which is a drive source and rotated by the geared motor M, the driven roller R2 driven by coming into pressure contact with the drive roller R1. The drive rollers R1 and the driven rollers R2 of the sheet transfer roller pairs R form a sheet transfer unit configured to transfer the sheet P while holding the sheet P between the drive rollers R1 and the driven rollers R2.

Providing the sheet transfer device 70 along the horizontal transfer route JR3 in the circulation transfer route JR allows a jammed sheet JP (FIGS. 9A, 9B, 10A, and 10B) to be easily taken out from the device 70 when sheet jam occurs across, for example, the first vertical transfer route JR2 and the horizontal transfer route JR3 in the circulation transfer route JR, without leaving any part of the jammed sheet JP in the transfer routes JR2 and JR3.

Since the belt platen unit 30 is arranged above the sheet transfer device 70 and a space KU large enough for a person to insert his/her hand from a front side (front surface side) of the sheet transfer device 70 is formed between the belt platen unit 30 and the device 70, the jammed sheet JP can be recovered by inserting the person's hand into the space KU as will be described later.

Description is given by using both of FIGS. 1 and 2. In the sheet transfer device 70, the drive-side sheet transfer guide plate (hereafter, referred to as drive-side sheet guide plate) 71 and the driven-side sheet transfer guide plate (hereafter, referred to as driven-side sheet guide plate) 81 are arranged along, for example, the horizontal transfer route JR3 in the circulation transfer route JR to face each other. The rotatable drive rollers R1 connected to the geared motor M which is a drive source are attached to the drive-side sheet guide plate 71. The driven rollers R2 rotated by the drive rollers R1 are attached to the driven-side sheet guide plate 81. The sheet transfer roller pairs R which are pairs of the drive rollers R1 and the driven rollers R2 hold each of the sheets P and transfer the sheet P in the sheet transfer direction.

The drive-side sheet guide plate 71 is fixed to a fixation member (not illustrated) in the device 70 and guides one surface (bottom surface) Pa of the sheet P transferred in the sheet transfer direction by the multiple drive rollers R1.

The driven-side sheet guide plate 81 faces a top surface 71*a* of the drive-side sheet guide plate 71 with a small gap arranged therebetween, and guides the other surface (top surface) Pb of the sheet P transferred in the sheet transfer direction by the multiple driven rollers R2.

The driven-side sheet guide plate 81 is divided into two parts of: the first divided sheet guide plate 82 arranged to be capable of being drawn out to a position on the front side (front surface side) which is one surface side of the device 70; and the second divided sheet guide plate 83 arranged to stay on a rear side (rear surface side), which is another surface side of the device 70 opposite to the one surface side, in such a way as to be capable of being turned (opened and closed) as needed.

The front side (front surface side) of the device 70 is set to be one side of a sheet width direction orthogonal to the transfer direction of the sheet P, and the rear side (rear surface side) of the device 70 is set to be the other side of the sheet width direction orthogonal to the transfer direction of the sheet P.

A dividing line BL between the first and second divided sheet guide plates 82 and 83 is set to extend substantially along the transfer direction of the sheet P, near a center line of the driven-side sheet guide plate 81 in the sheet width direction orthogonal to the sheet transfer direction.

The dividing position of the driven-side sheet guide plate 81 is set between an end portion Pc of the sheet P on the front side of the device 70 and the center line of the sheet P in the width direction thereof or on the center line of the sheet P in the width direction thereof, the sheet P being a sheet of the smallest size among the sheets of various sizes which are transferred along the sheet transfer route. The sheets P of various sizes can be thereby surely taken out.

The first divided sheet guide plate 82 forming part of the driven-side sheet guide plate 81 is arranged on the one side of the sheet width direction orthogonal to the sheet transfer direction to be capable of being drawn out in the width direction of the sheet P which corresponds to the left end portion Pc of the sheet P in the width direction.

The first divided sheet guide plate 82 is attached to be capable of being drawn out in the draw-out direction to a position on the front side (front surface side) of the device 70 while being guided by paired draw-out guide plates 75 and 76 arranged respectively on an upstream portion and a downstream portion of the drive-side sheet guide plate 71 in the sheet transfer direction.

The second divided sheet guide plate 83 forming part of the driven-side sheet guide plate 81 is arranged to stay on the other side of the sheet width direction which is opposite to the one side and which corresponds to a right end portion Pd of the sheet P in the width direction. Moreover, the second divided sheet guide plate 83 is supported in a rear side (rear surface side) portion of the device 70 to be turnable about paired turning shafts 86 (only one is illustrated) arranged parallel to the sheet transfer direction.

When the first divided sheet guide plate 82 is housed inside the device 70, an outer surface 82*d* of the first divided sheet guide plate 82 on the downstream side in the sheet transfer direction overlaps an outer surface 83*d* of the second divided sheet guide plate 83 on the downstream side in the sheet transfer direction. This will be described in detail later.

As shown in FIG. 3, the drive-side sheet guide plate 71 is formed by using a metal plate material and has the top surface 71*a* including: a first flat surface 71*a*1 formed such that the length thereof in the sheet transfer direction is long; a recess-shaped curved surface 71*a*2 connected to a downstream portion of the first flat surface 71*a*1 and curved in a recess shape extending upward by a small amount; and a second flat surface 71*a*3 formed downstream of the recess-shaped curved surface 71*a*2 at a height slightly higher than the first flat surface 71*a*1 such that the length thereof in the sheet transfer direction is short, the surfaces 71*a*1, 71*a*2, and 71*a*3 being arranged in this order from the upstream side to the downstream side in the transfer direction of the sheets P. Moreover, front and rear surfaces 71*c* and 71*d* corresponding respectively to the front and rear sides are formed by being bent downward.

In the first embodiment, the downstream portion of the top surface 71*a* of the drive-side sheet guide plate 71 is provided with the recess-shaped curved surface 71*a*2 to curve in the recess shape extending upward to a position higher than the upstream portion of the top surface 71*a* by a predetermined amount, due to reasons such as arrangement relationships of peripheral parts.

The drive-side sheet guide plate 71 is formed in a substantially-rectangular shape with the dimension thereof in the sheet transfer direction being set to an appropriate value according to the unitization and with the dimension thereof in the sheet width direction being set to a value larger than the width dimension of the sheet of the largest size (for example, A3 size).

Multiple rectangular holes 71*e* are formed on front left, front right, rear left, and rear right sides of an intermediate portion of the first flat surface 71*a*1 of the drive-side sheet guide plate 71 to penetrate the drive-side sheet guide plate 71. The drive rollers R1 of the sheet transfer roller pairs R are exposed from the multiple rectangular holes 71*e* to slightly protrude from the bottom surface 71*b* side to the top surface 71*a* side.

The drive rollers R1 are fixedly attached to two long first roller shafts 72 which are rotatably supported between the front and rear surfaces 71*c* and 71*d* of the drive-side sheet guide plate 71 and which are provided at a predetermined interval in the sheet transfer direction while extending in the sheet width direction. The drive rollers R1 are fixedly attached to the first roller shafts 72 in a manner substantially symmetric in the sheet width direction with respect to an imaginary transfer center line in the transfer of the sheet P.

Note that the various types of sheets P different in size are transferred on the drive-side sheet guide plate 71 while being nipped by the drive rollers R1 and the driven rollers R2 (FIG. 1) with the centers thereof being aligned with the imaginary transfer center line in the transfer of the sheets P and without the positions of the left and right end portions Pc and Pd (FIG. 2) of the sheets P being restricted.

Multiple finger holes 71*f* are formed in a front side portion of the first flat surface 71*a*1 of the drive-side sheet guide plate 71 at positions corresponding respectively to the left end portions Pc (FIG. 2) of the various types of sheets P different in size to penetrate the drive-side sheet guide plate 71. As will be described later, these multiple finger holes 71*f* function as escape holes used when a user holds a draw-out-side end portion of the jammed sheet JP (FIGS. 9A, 9B, 10A, and 10B) placed on the drive-side sheet guide plate 71 with his/her fingers.

Paired L-shaped brackets 73 and 74 are symmetrically attached onto the first flat surface 71*a*1 of the drive-side sheet guide plate 71 separately at positions on the upstream side and the downstream side near the rear surface 71*d* in such a way as not to affect the transfer of the sheet P. The paired L-shaped brackets 73 and 74 have a function of turnably supporting the paired turning shafts 86 (FIGS. 2 and 4) attached to a rear end of the second divided sheet guide plate 83 located in the rear side portion of the driven-side sheet guide plate 81 (FIGS. 2 and 4).

The paired draw-out guide plates 75 and 76 are symmetrically attached onto the first and second flat surfaces 71*a*1 and 71*a*3 to extend in the sheet width direction and to face each other while being arranged respectively in the upstream portion and the downstream portion at an interval in the sheet transfer direction, the first and second flat surfaces 71*a*1 and 71*a*3 formed at different height levels in the upstream portion and the downstream portion of the top surface 71*a* of the drive-side sheet guide plate 71.

Not-illustrated other sheet transfer devices are attached on outer sides of the paired draw-out guide plates 75 and 76 in the sheet transfer direction.

The paired draw-out guide plates 75 and 76 have a function of causing only the first divided sheet guide plate 82 of the driven-side sheet guide plate 81 (FIGS. 2 and 4) to be drawn out to a position on the front side.

In lower portions of the paired draw-out guide plates 75 and 76 which face the top surface 71*a* of the drive-side sheet guide plate 71, sheet passage ports 75*a* and 76*a* through which the sheet P (FIGS. 1 and 2) passes are formed in recess shapes to extend in the sheet width direction. Moreover, in the paired draw-out guide plates 75 and 76, paired inclined guide grooves 75*b* and 76*b* are formed in an inclined manner to guide the first divided sheet guide plate 82 (FIGS. 2 and 4) in such a way that the first divided sheet guide plate 82 can be gradually drawn out from the rear side to a position on the front side in an oblique upward direction.

Small-diameter pins 84 (FIG. 4) and large-diameter pins 85 (FIG. 4) attached to upstream and downstream outer surfaces 82*c* and 82*d* (FIG. 4) of the first divided sheet guide plate 82 (FIGS. 2 and 4) are fitted into the paired inclined guide grooves 75*b* and 76*b* formed in the paired draw-out guide plates 75 and 76.

Moreover, first positioning recesses 75*b*1 and 76*b*1 are formed at front side ends of the inclined guide grooves 75*b* and 76*b* of the paired draw-out guide plates 75 and 76 in a shape recessed downward. Meanwhile, second positioning recesses 75*b*2 and 76*b*2 are formed in rear side portions of the inclined guide grooves 75*b* and 76*b* in a shape recessed downward.

Causing the small-diameter pins 84 on the front side in the draw-out direction to fall into the first positioning recesses 75*b*1 and 76*b*1 positions the first divided sheet guide plate 82 at a maximum draw-out position, the small-diameter pins 84 being attached to the outer surfaces 82*c* and 82*d* of the first divided sheet guide plate 82. Meanwhile, causing the small-diameter pins 84 to fall into the second positioning recesses 75*b*2 and 76*b*2 positions the first divided sheet guide plate 82 at a housed position.

A locked member 91 of a lock mechanism 90 is fixedly attached to a portion of the top surface 71*a* of the drive-side sheet guide plate 71 which is substantially at the center in the sheet transfer direction and which is on the front surface 71*c* side. The lock mechanism 90 is used to lock the first divided sheet guide plate 82 (FIGS. 2 and 4) to the drive-side sheet guide plate 71 when the first divided sheet guide plate 82 is housed in the device 70.

As shown in FIG. 4, the first and second divided sheet guide plates 82 and 83 forming the driven-side sheet guide plate 81 are formed such that insides thereof on top surfaces 82*a* and 83*a* side are provided with frameworks formed of multiple reinforcement ribs made of a resin material and are thus formed to be stiff frame bodies.

Bottom surfaces 82*b* (and 83*b*, FIG. 6) of the first and second divided sheet guide plates 82 and 83 face the top surface 71*a* of the drive-side sheet guide plate 71 (FIG. 3) and are formed to be flat surfaces extending along the shape of the top surface 71*a* from the upstream side to the downstream side in the sheet transfer direction. Moreover, portions of the bottom surfaces 82*b* and 83*b* near downstream ends are curved upward.

As shown in FIGS. 4 and 5, in the first divided sheet guide plate 82 of the driven-side sheet guide plate 81 arranged above the drive-side sheet guide plate 71 in the front side portion of the device 70 (FIGS. 1 and 2), the upstream and downstream outer surfaces 82*c* and 82*d* extend toward the rear side beyond the dividing line BL and are thus formed to have long dimensions in the sheet width direction.

The small-diameter pins 84 on the front side in the draw-out direction and the large-diameter pins 85 on the rear side in the draw-out direction are fixedly attached to the rear side portions of the outer surfaces 82*c* and 82*d* of the first divided sheet guide plate 82 to extend outward.

The two small-diameter pins 84 and the two large-diameter pins 85 fixedly attached to the outer surfaces 82*c* and 82*d* of the first divided sheet guide plate 82 are fitted into the paired inclined guide grooves 75*b* and 76*b* to be capable of being drawn out, the inclined guide grooves 75*b* and 76*b* being formed in the paired draw-out guide plates 75 and 76 attached onto the drive-side sheet guide plate 71 described above by using FIG. 3.

Inside the outer surfaces 82*c* and 82*d* of the first divided sheet guide plate 82, a portion of the first divided sheet guide plate 82 on the rear side of the dividing line BL is cut away along lines which are parallel to the outer surfaces 82*c* and 82*d* and which are located inside the outer surfaces 82*c* and 82*d* away therefrom in the sheet transfer direction by the narrow width W1, and a rectangular recess 82*e* having a large area is thereby formed.

When the first divided sheet guide plate 82 is housed in the device 70, the second divided sheet guide plate 83 on the rear side is located in the rectangular recess 82*e*.

As described above, when the rectangular recess 82*e* of the first divided sheet guide plate 82 is formed, two wing portions 82*e*1 and 82*e*2 are formed inside the outer surfaces 82*c* and 82*d* of the first divided sheet guide plate 82. The wing portions 82*e*1 and 82*e*2 are formed respectively in the upstream portion and the downstream portion of the first divided sheet guide plate 82 at an interval to each have the narrow width of W1 and to extend toward the rear side in an elongated manner.

Inner surfaces of the upstream and downstream wing portions 82*e*1 and 82*e*2 formed along the rectangular recess 82*e* of the first divided sheet guide plate 82 are parallel to upstream and downstream outer surfaces 83*c* and 83*d* (FIG. 6) of the second divided sheet guide plate 83 to be described later.

The width dimension W2 between the inner surfaces of the upstream and downstream wing portions 82*e*1 and 82*e*2 formed along the rectangular recess 82*e* of the first divided sheet guide plate 82 is set to be slightly wider than the width dimension W3 (FIG. 6) between the upstream and downstream outer surfaces 83*c* and 83*d* of the second divided sheet guide plate 83.

When the top surface 71*a* (FIG. 3) of the drive-side sheet guide plate 71 is set as the reference of height, the height H2 of the downstream wing portion 82*e*2 formed along the rectangular recess 82*e* of the first divided sheet guide plate 82 is set to be higher than the height H1 of the upstream wing portion 82*e*1 and the height H1 (FIG. 6) of the upstream outer surface 83*c* of the second divided sheet guide plate 83, due to the curved shape of the downstream portion of the drive-side sheet guide plate 71 (FIG. 3).

The push-in prohibiting portion 82*e*3 connected to an upper portion of the downstream wing portion 82*e*2 of the first divided sheet guide plate 82 is formed to protrude inward (toward the upstream side) from the wing portion 82*e*2 by the width dimension W4.

The height H3 from a bottom surface of the downstream wing portion 82*e*2 to a bottom surface of the push-in prohibiting portion 82*e*3 is set to be slightly higher than the height H4 (FIG. 6) of the downstream outer surface 83*d* of the second divided sheet guide plate 83.

When the first divided sheet guide plate 82 is housed in the device 70, a portion of the second divided sheet guide plate 83 on the downstream outer surface 83*d* side is disposed below the bottom surface of the push-in prohibiting portion 82*e*3 formed in the downstream portion of the first divided sheet guide plate 82, at a position lower than the downstream wing portion 82*e*2 such that the wing portion 82*e*2 and the outer surface 83*d* overlap each other. Operations of the push-in prohibiting portion 82*e*3 will be described later.

An inner rear surface 82*e*4 of the first divided sheet guide plate 82 is formed along the rectangular recess 82*e* of the first divided sheet guide plate 82 to extend substantially along the dividing line BL and to face a front surface 83*e* (FIG. 6) of the second divided sheet guide plate 83.

Two pushing pins 82*e*5 are formed to be connected to an outer portion of the inner rear surface 82*e*4 formed along the rectangular recess 82*e* of the first divided sheet guide plate 82. The pushing pins 82*e*5 are arranged on the upstream side and the downstream side at an interval to protrude toward the rear side. The downstream pushing pin 82*e*5 out of the two pushing pins 82*e*5 is also connected to an outer portion of a downstream box portion 82*f* to be described below.

The two pushing pins 82*e*5 have a function of pushing a portion of the second divided sheet guide plate 83 on the front surface 83*e* side toward the top surface 71*a* (FIG. 3) of the drive-side sheet guide plate 71.

On the top surface 82*a* of the first divided sheet guide plate 82, two box portions 82*f* are formed near the dividing line BL separately on the upstream side and the downstream side to protrude with upper portions thereof being closed by lids. The driven rollers R2 (FIG. 1) are housed in the box portions 82*f* to face the drive rollers R1 (FIGS. 1 and 3).

Note that description is given later of a mechanism which brings the driven rollers R2 housed in the box portions 82*f* into pressure contact with the drive rollers R1 with the sheet P interposed therebetween.

Inspection holes 82*g* for checking whether the jammed sheet JP (FIGS. 9A, 9B, 10A, and 10B) is placed on the drive-side sheet guide plate 71 (FIGS. 2 and 3) are formed in the top surface 82*a* of the first divided sheet guide plate 82 between the two box portions 82*f* to penetrate the first divided sheet guide plate 82.

A handle 82*i* is formed in a substantially-center portion of a front surface 82*h* of the first divided sheet guide plate 82 in the sheet transfer direction to protrude to a position on the front side. The user can draw out the first divided sheet guide plate 82 to a position on the front side by pulling the handle 82*i* to the front side.

An unlock lever 92 of the lock mechanism 90 is attached to a rear portion of the handle 82*i* arranged on the front surface 82*h* of the first divided sheet guide plate 82 to correspond to the aforementioned locked member 91 of the lock mechanism 90 arranged in the aforementioned drive-side sheet guide plate 71 (FIG. 3).

The lock mechanism 90 may have any structure mode as long as the structure of the lock mechanism 90 is such that the first divided sheet guide plate 82 is locked to the drive-side sheet guide plate 71.

As shown in FIGS. 4 and 6, the second divided sheet guide plate 83 of the driven-side sheet guide plate 81 arranged above the drive-side sheet guide plate 71 in the rear side portion of the device 70 (FIGS. 1 and 2) is housed in the rectangular recess 82*e* of the first divided sheet guide plate 82 as described above. The second divided sheet guide plate 83 is thus formed to be smaller than the first divided sheet guide plate 82.

The width dimension W3 between the upstream and downstream outer surfaces 83*c* and 83*d* of the second divided sheet guide plate 83 is set to be slightly narrower than the width dimension W2 (FIG. 5) between the inner surfaces of the upstream and downstream wing portions 82*e*1 and 82*e*2 formed along the rectangular recess 82*e* of the first divided sheet guide plate 82 as described above.

Like the first divided sheet guide plate 82, the second divided sheet guide plate 83 also faces the top surface 71*a* of the drive-side sheet guide plate 71 (FIG. 3) and is formed flat to extend from the upstream side to the downstream side in the sheet transfer direction and curve upward near the downstream end portion along the shape of the top surface 71*a*.

Two recesses 83*e*1 are formed in an inner portion of the front surface 83*e* of the second divided sheet guide plate 83, at an interval in the sheet transfer direction. The recesses 83*e*1 are each formed in a recess shape with front and upper portions thereof being open. The downstream recess 83*e*1 out of the two recesses 83*e*1 is connected also to an outer portion of a downstream box portion 83*f* to be described below.

The two pushing pins 82*e*5 (FIG. 5) formed to protrude in the outer portion of the inner rear surface 82*e*4 in the rectangular recess 82*e* of the first divided sheet guide plate 82 can be inserted into and removed from the two recesses 83*e*1 to be positioned in a left-right direction of the device 70.

Also on the top surface 83*a* of the second divided sheet guide plate 83, two box portions 83*f* are formed near the dividing line BL separately on the upstream side and the downstream side to protrude with upper portions thereof being closed by lids. The driven rollers R2 (FIG. 1) are housed in the box portions 83*f* to face the drive rollers R1 (FIGS. 1 and 3).

An inspection hole 83*g* for checking whether the jammed sheet JP (FIGS. 9A, 9B, 10A, and 10B) exist on the drive-side sheet guide plate 71 (FIGS. 2 and 3) is also formed in the top surface 83*a* of the second divided sheet guide plate 83 between the two box portions 83*f* to penetrate the second divided sheet guide plate 83.

In the case where the first and second divided sheet guide plates 82 and 83 of the driven-side sheet guide plate 81 are configured as described above, as shown in the plan view of FIG. 7, the push-in prohibiting portion 82*e*3 formed in the downstream portion of the first divided sheet guide plate 82 and the portion of the second divided sheet guide plate 83 on the downstream outer surface 83*d* side overlap each other in the direction of gravity when the first divided sheet guide plate 82 is housed in the device 70 (FIGS. 1 and 2). Since the second divided sheet guide plate 83 is housed below the inner surface of the wing portion 82*e*2 and the push-in prohibiting portion 82*e*3 formed in the downstream portion of the first divided sheet guide plate 82, the second divided sheet guide plate 83 does not affect at all the draw-out operation and the push-in operation of the first divided sheet guide plate 82 by the user.

Figures 8A, 8B, 8C:
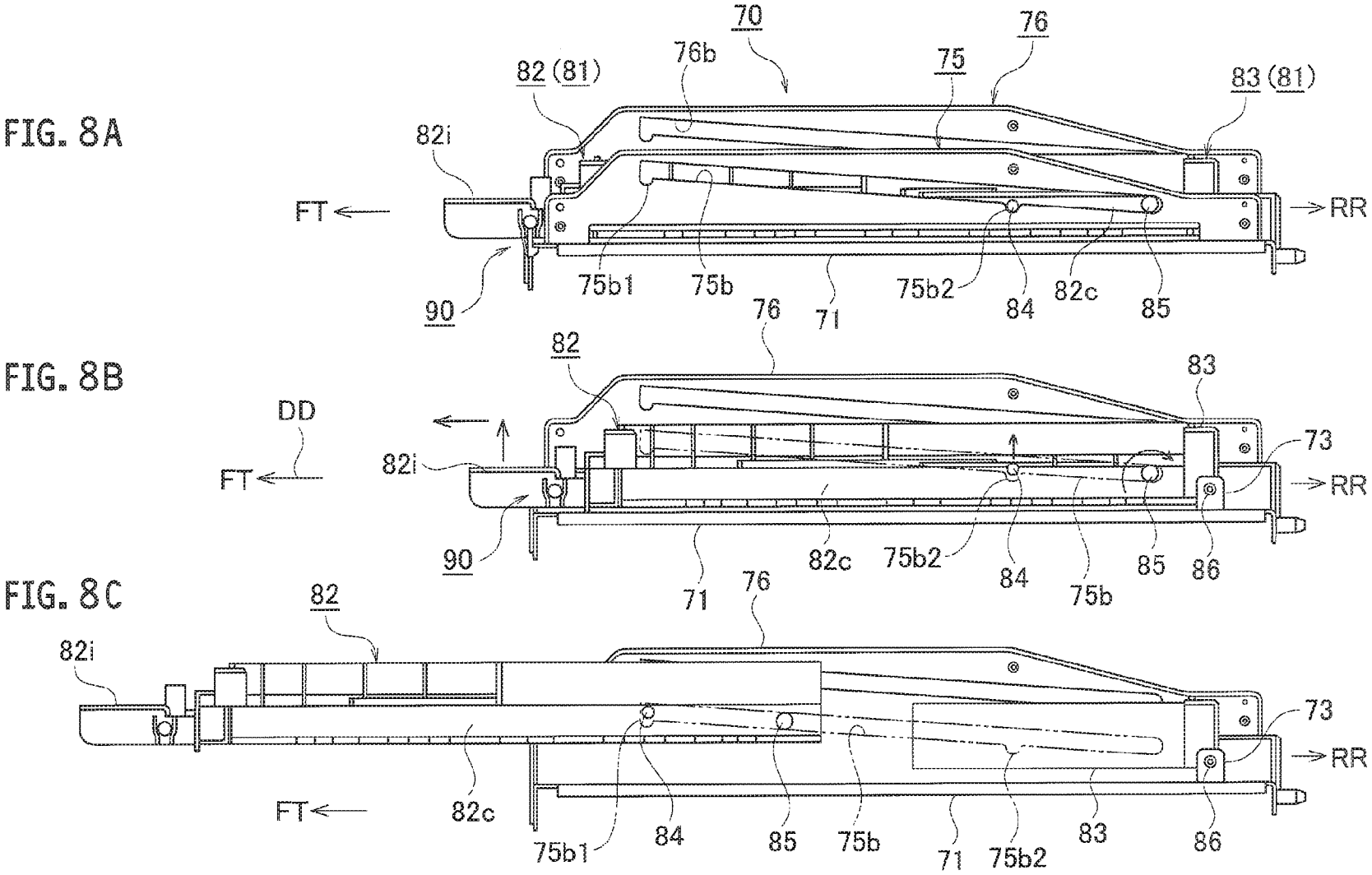
FIGS. 8A to 8C are views for explaining operations of drawing out the first divided sheet guide plate of the driven-side sheet transfer guide plate from the inside of the device to a position on a front side in the sheet transfer device of the first embodiment.

Next, by using FIGS. 8A to 8C, description is given of an operation of drawing out the first divided sheet guide plate 82 of the driven-side sheet guide plate 81 to a position on the front side from the inside of the sheet transfer device 70 of the first embodiment configured as described above.

FIGS. 8A to 8C show the operation of drawing out the first divided sheet guide plate 82. FIG. 8A is a side view of the paired draw-out guide plates 75 and 76 as viewed in the sheet transfer direction from the upstream side toward the downstream side. FIGS. 8B and 8C are side cross-sectional views in which the upstream draw-out guide plate 75 is omitted and the inclined guide groove 75*b* of the upstream draw-out guide plate 75 is shown by two-dot chain lines. FIG. 8A shows a state where the first divided sheet guide plate 82 is locked, FIG. 8B shows a state where the drawing-out of the first divided sheet guide plate 82 is started, and FIG. 8C shows a state where the drawing-out of the first divided sheet guide plate 82 is completed.

Note that, in the following description of the operation of drawing out the first divided sheet guide plate 82, only the upstream outer surface 82*c* side of the first divided sheet guide plate 82 is described, and description of the downstream outer surface 82*d* (FIGS. 4 and 5) side which is formed at a different height from that of the upstream outer surface 82*c* side is omitted.

First, as shown in FIG. 8A, in the sheet transfer device 70, the first divided sheet guide plate 82 of the driven-side sheet guide plate 81 is housed in the front side portion of the device 70 while facing the drive-side sheet guide plate 71, and the second divided sheet guide plate 83 of the driven-side sheet guide plate 81 is housed in the rear side portion of the device 70 at the same height as the first divided sheet guide plate 82 not being drawn out yet. In this case, the first and second divided sheet guide plates 82 and 83 maintain a posture substantially parallel to the drive-side sheet guide plate 71 while facing the drive-side sheet guide plate 71 with the bottom surfaces thereof located at the same height.

In this case, the small-diameter pin 84 on the front side in the draw-out direction out of the small-diameter pin 84 and the large-diameter pin 85 which are fixedly attached to the outer surface 82*c* of the first divided sheet guide plate 82 engages with the second positioning recess 75*b*2 on the rear side formed in the inclined guide groove 75*b* of the upstream draw-out guide plate 75, and the large-diameter pin 85 on the rear side in the draw-out direction is positioned at the rear end of the inclined guide groove 75*b*. The first divided sheet guide plate 82 is thus positioned at the housed position.

Moreover, the first divided sheet guide plate 82 is locked to the drive-side sheet guide plate 71 by the lock mechanism 90 arranged in the rear portion of the handle 82*i* of the first divided sheet guide plate 82.

Hence, when the first divided sheet guide plate 82 is locked, the sheet transfer device 70 is set to a state where the sheet transfer roller pairs R (FIGS. 1, 9A, and 9B) can transfer (pass) the sheet P in the sheet transfer device 70.

Next, as shown in FIG. 8B, when sheet jam occurs in the sheet transfer device 70 and the user unlocks the lock mechanism 90 and raises the handle 82*i* of the first divided sheet guide plate 82, the first divided sheet guide plate 82 is turned clockwise about the large-diameter pin 85 fixedly attached to the outer surface 82*c*, in the inclined guide groove 75*b* illustrated by the two-dot chain line.

This causes the small-diameter pin 84 fixedly attached to the outer surface 82*c* to move out from the second positioning recess 75*b*2 on the rear side and enter the inclined guide groove 75*b*. The user then starts to draw out the first divided sheet guide plate 82 to a position on the front side which is the draw-out direction while grabbing the handle 82*i*.

Then, with the draw-out operation of the first divided sheet guide plate 82 to a position on the front side, the driven rollers R2 (FIGS. 1, 9A, and 9B) in the first divided sheet guide plate 82 are moved away from the drive rollers R1 (FIGS. 1, 9A, and 9B) in the drive-side sheet guide plate 71 and nipping of the sheet P (FIGS. 1 and 2) is released as will be described later.

Meanwhile, the second divided sheet guide plate 83 turnably supported via the turning shaft 86 by the L-shaped bracket 73 attached to the rear end of the drive-side sheet guide plate 71 is not turned and maintains the posture substantially parallel to the drive-side sheet guide plate 71 to stay at the housed position.

Next, as shown in FIG. 8C, when the user further draws out the first divided sheet guide plate 82 to a position on the front side, the small-diameter pin 84 and the large-diameter pin 85 fixedly attached to the outer surface 82*c* of the first divided sheet guide plate 82 are guided obliquely upward along the inclined guide groove 75*b* illustrated by the two-dot chain line.

Thereafter, when the small-diameter pin 84 engages with the first positioning recess 75*b*1 on the front side which is formed in the inclined guide groove 75*b*, the first divided sheet guide plate 82 is positioned at the maximum draw-out position on the front side.

Moreover, when the small-diameter pin 84 engages with the first positioning recess 75*b*1, the front end of the first divided sheet guide plate 82 slightly falls and the first divided sheet guide plate 82 is made to maintain the posture substantially parallel to the drive-side sheet guide plate 71 at a position higher than the second divided sheet guide plate 83. The draw-out of the first divided sheet guide plate 82 is thus completed.

Meanwhile, the second divided sheet guide plate 83 maintains the posture substantially parallel to the drive-side sheet guide plate 71 at the position on the rear side away from the first divided sheet guide plate 82.

When the first divided sheet guide plate 82 is positioned at the maximum draw-out position on the front side, the user can easily take out the jammed sheet JP placed on the drive-side sheet guide plate 71 from the device 70 without leaving any part of the jammed sheet JP in the device 70 even if the jammed sheet JP (FIGS. 9A, 10A, and 10B) exists across the sheet transfer device and its adjacent sheet transfer device (not illustrated) as will be described later.

Figures 9A, 9B:
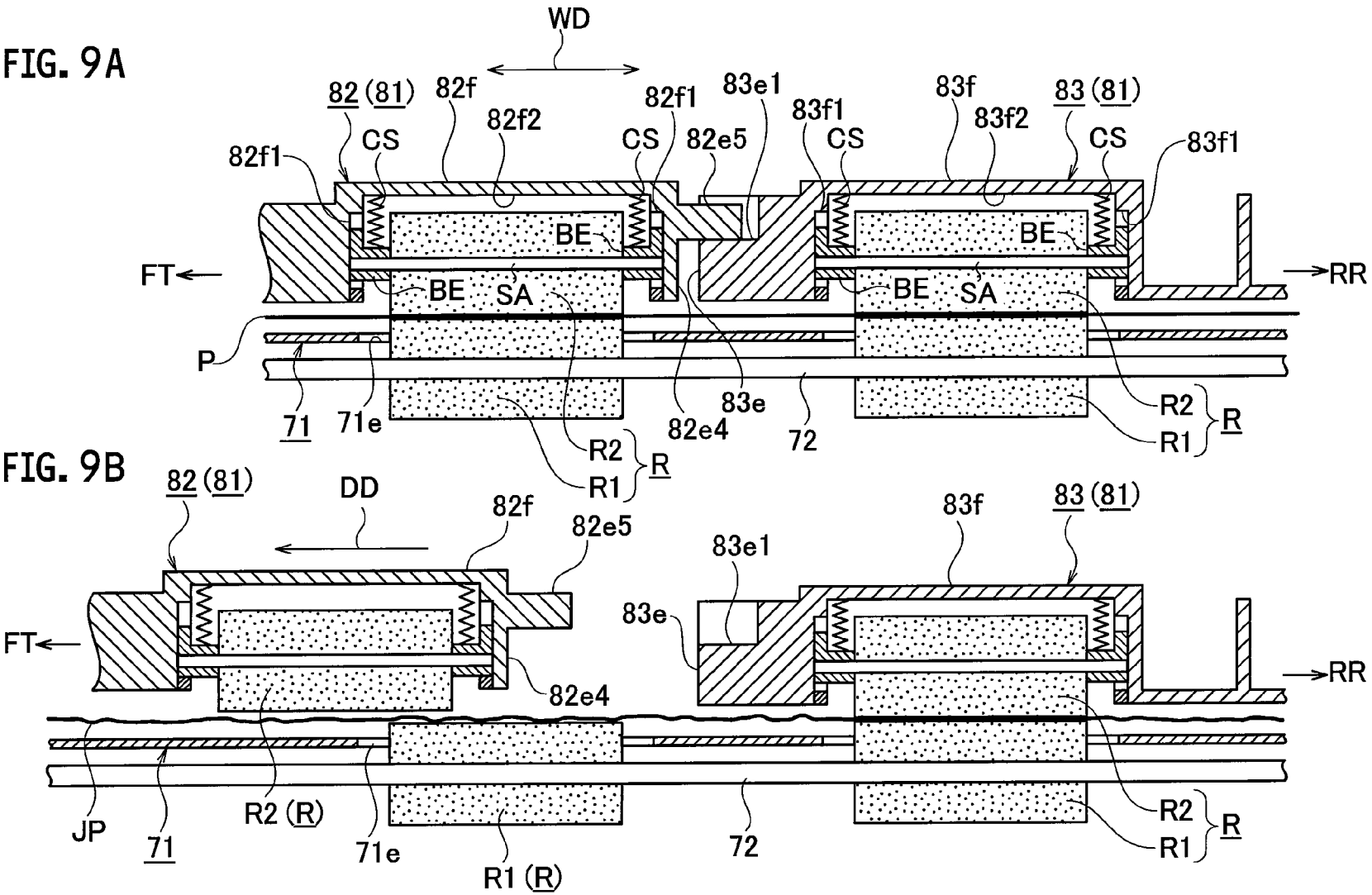
FIGS. 9A and 9B are vertical cross-sectional views of the sheet transfer device of the first embodiment which are taken along the X-X line of FIG. 2 and which show a nipping state of drive rollers and driven rollers of sheet transfer roller pairs.

By using FIGS. 9A and 9B, description is given of a nipping state of the drive rollers R1 and the driven rollers R2 of the sheet transfer roller pairs R shown in FIG. 1 in the transferring of the sheet P in the sheet transfer device 70.

FIGS. 9A and 9B show the nipping state of the drive rollers R1 and the driven rollers R2 of the sheet transfer roller pairs R at a cross section taken along the X-X line shown in FIG. 2. FIG. 9A shows a state where the first divided sheet guide plate 82 is locked. FIG. 9B shows a state where the first divided sheet guide plate 82 is drawn out.

As shown in FIG. 9A, the drive rollers R1 of the sheet transfer roller pairs R are fixedly attached to the long first roller shaft 72 formed to extend in the sheet width direction below the drive-side sheet guide plate 71, and are exposed from the rectangular holes 71*e*.

Meanwhile, the driven rollers R2 of the sheet transfer roller pairs R are fixedly attached to short second roller shafts SA which are formed to extend in the sheet width direction in the box portions 82*f* and 83*f* formed respectively in the first and second divided sheet guide plates 82 and 83 of the driven-side sheet guide plate 81, and bearings BE are fitted to both ends of each of the second roller shafts SA.

Moreover, bearing supporting bottomed holes 82*f*1 and 83*c*1 are formed on both side portions, in the sheet width direction, of the box portions 82*f* and 83*f* formed respectively in the first and second divided sheet guide plates 82 and 83. The bearings BE fitted to both ends of the second roller shafts SA are fitted into the bearing supporting bottomed holes 82*f*1 and 83*c*1 loosely in the vertical direction while being stopped from rotating by upper portions of the bearings BE. Moreover, compression springs CS are arranged between the bearings BE and interior ceiling surfaces 82*f*2 and 83*c*2 of the box portions 82*f* and 83*f*.

The pushing pins 82*e*5 connected to the outer portion of the inner rear surface 82*e*4 of the first divided sheet guide plate 82 and the outer portion of the box portion 82*f* of the first divided sheet guide plate 82 are formed to protrude toward the rear side. Meanwhile, the recesses 83*e*1 connected to the inner portion of the front surface 83*e* of the second divided sheet guide plate 83 and the outer portion of the box portion 83*f* of the second divided sheet guide plate 83 are formed to be open toward the front side.

Since the pushing pins 82*e*5 formed in the first divided sheet guide plate 82 enter the recesses 83*e*1 formed in the second divided sheet guide plate 83 and are placed on the recesses 83*e*1 when the first divided sheet guide plate 82 is locked to the drive-side sheet guide plate 71, the front end portion of the second divided sheet guide plate 83 on the front side is held down toward the drive-side sheet guide plate 71.

Due to this, in the locked state, the driven rollers R2 housed in the box portions 82*f* and 83*f* formed respectively in the first and second divided sheet guide plates 82 and 83 can come into pressure contact with the drive rollers R1 with the sheet P interposed therebetween, by biasing force of the compression springs CS and thereby transfer the sheet P.

Meanwhile, as shown in FIG. 9B, when the first divided sheet guide plate 82 is unlocked from the drive-side sheet guide plate 71 and is then drawn out to a position on the front side, the pushing pins 82*e*5 formed to be connected to the inner rear surface 82*e*4 and the box portion 82*f* of the first divided sheet guide plate 82 are moved away from the recesses 83*e*1 formed to be connected to the front surface 83*e* and the box portion 83*f* of the second divided sheet guide plate 83, with the draw-out operation of the first divided sheet guide plate 82. Accordingly, the second divided sheet guide plate 83 is no longer held down by the first divided sheet guide plate 82.

Due to this, regarding pressing contact force to the drive roller R1 applied by the driven roller R2 housed in the box portion 83*f* of the second divided sheet guide plate 83, although the weight of the driven roller R2 is applied to the drive roller R1, the biasing force of the compression springs CS is reduced. This facilitates take out of the jammed sheet JP (FIGS. 9A, 9B, 10A, and 10B) nipped by the sheet transfer roller pair R on the second divided sheet guide plate 83 side.

Furthermore, when the first divided sheet guide plate 82 is drawn out to a position on the front side, the first divided sheet guide plate 82 is moved obliquely upward along the inclined guide grooves 75*b* and 76*b* of the paired draw-out guide plates 75 and 76 (FIG. 3). Accordingly, the driven roller R2 housed in the box portion 82*f* of the first divided sheet guide plate 82 is gradually moved away from the drive roller R1 and the nipping between the rollers R1 and R2 is released. The nipping of the jammed sheet JP placed on the drive-side sheet guide plate 71 is thus released.

Figure 10A:
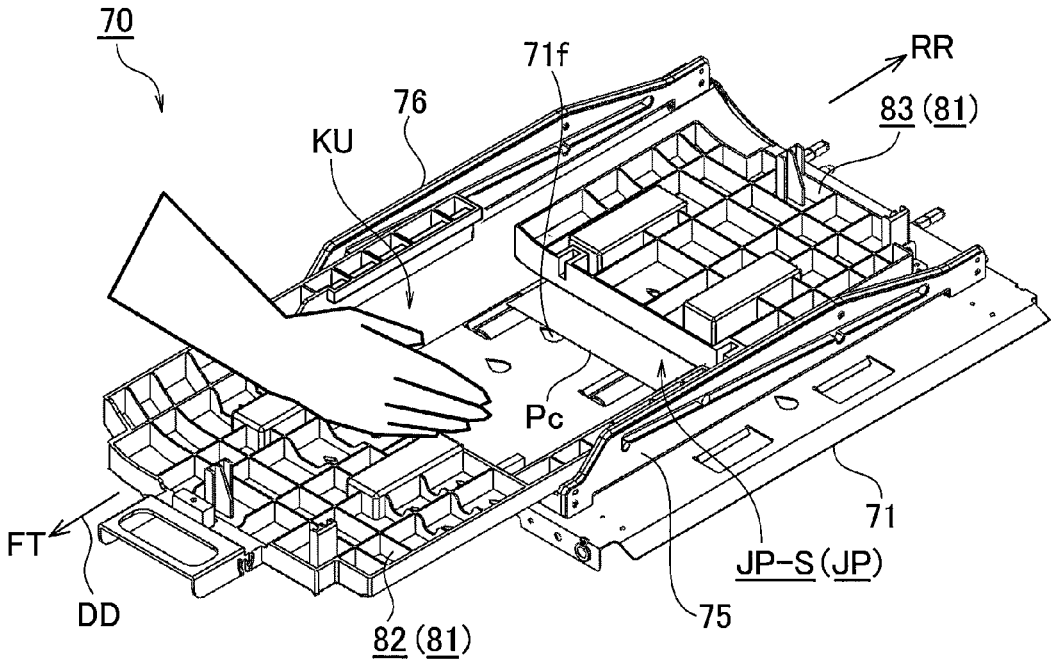
FIGS. 10A and 10B are perspective views each showing a situation where a jammed sheet is to be taken out from the inside of the sheet transfer device of the first embodiment.
Figure 10B:
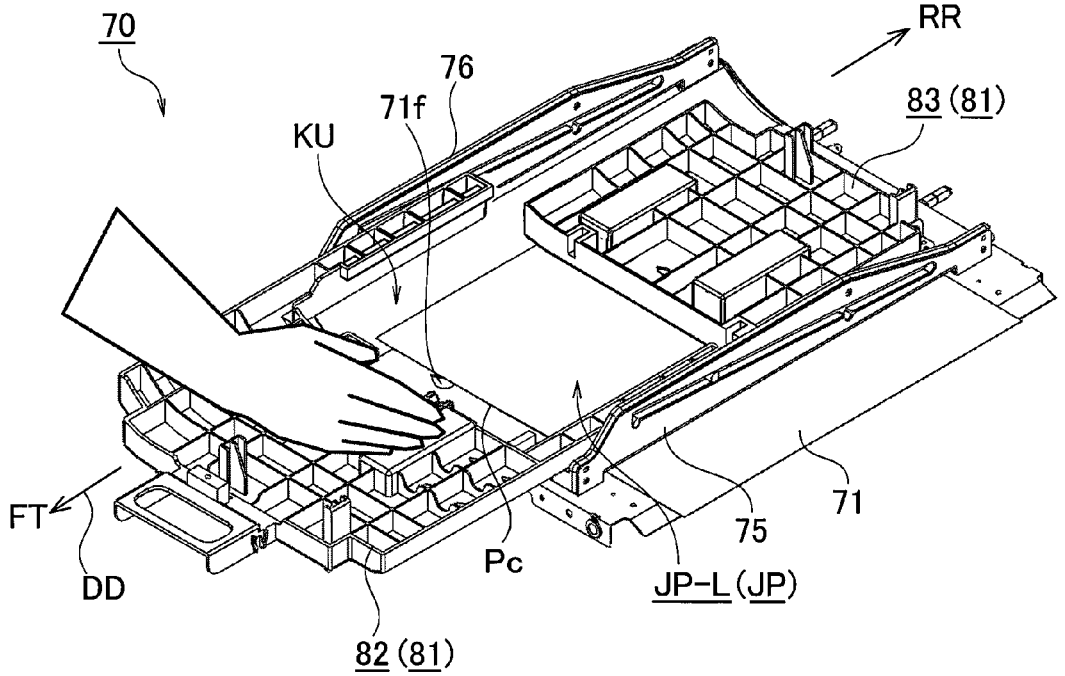

Next, by using FIGS. 10A and 10B, description is given of a method of taking out the jammed sheet JP from an inside of the sheet transfer device 70.

FIGS. 10A and 10B are perspective views of a situation where the jammed sheet JP is taken out from the inside of the sheet transfer device 70. FIG. 10A shows take-out of a jammed sheet JP-S of the smallest size. FIG. 10B shows take-out of a jammed sheet JP-L of the largest size.

As described above, whether sheet jam has occurred or not in the sheet transfer device 70 is detected by the sheet sensors S (FIG. 1) arranged at the appropriate positions along the sheet transfer route.

When the controller 60 (FIG. 1) recognizes occurrence of sheet jam, the controller 60 displays a warning on the operation panel 10 (FIG. 1) and, as shown in FIGS. 10A and 10B, the user manually draws out only the first divided sheet guide plate 82 out of the first and second divided sheet guide plates 82 and 83 forming the driven-side sheet guide plate 81, along the paired draw-out guide plates 75 and 76 to the maximum draw-out position.

In this case, in the sheet transfer device 70, the drive-side sheet guide plate 71 and the second divided sheet guide plate 83 stay at their original positions.

Moreover, as shown in FIG. 10B, the maximum draw-out position of the first divided sheet guide plate 82 is set at such a position that a person can grab the left end portion Pc, which is a draw-out side end portion, of the jammed sheet JP-L of the largest size (for example, A3 size) placed on the drive-side sheet guide plate 71 with his/her hand.

Furthermore, the space KU large enough for a person to insert his/her hand is formed above the first divided sheet guide plate 82 drawn out to a position on the front side of the device 70 as described above. Accordingly, the person inserts his/her hand into the space KU.

Then, as shown in FIG. 10A or 10B, the user holds the left end portion Pc, in the width direction, of the jammed sheet JP-S of the smallest size (for example, postcard size) or the jammed sheet JP-L of the largest size (for example, A3 size), which is the jammed sheet JP placed on the drive-side sheet guide plate 71, with his/her fingers at a corresponding one of the finger holes 71*f* formed in the drive-side sheet guide plate 71 at positions corresponding to the sheet sizes, and thereby takes out the jammed sheet JP from the device 70.

At this time, even if the jammed sheet JP placed on the drive-side sheet guide plate 71 exists across the sheet transfer device and its adjacent sheet transfer device (not illustrated), the jammed sheet JP placed on the drive-side sheet guide plate 71 is not drawn out in the draw-out of the first divided sheet guide plate 82. Accordingly, the jammed sheet JP is not torn in the draw-out operation of the first divided sheet guide plate 82.

Moreover, since the first divided sheet guide plate 82 refrains from holding down the second divided sheet guide plate 83 with the draw-out operation of the first divided sheet guide plate 82, a nipping pressure against the sheet P between the drive roller R1 and the driven roller R2 on the second divided sheet guide plate 83 side is reduced. This facilitates removal of the jammed sheet JP nipped by the sheet transfer roller pair R on the second divided sheet guide plate 83 side.

Moreover, when the first divided sheet guide plate 82 is drawn out toward the one surface side which is the front side of the device 70, the user can easily take out the jammed sheet JP from the device 70 with his/her hand without leaving any part of the jammed sheet JP in the device 70.

Furthermore, since the driven-side sheet guide plate 81 is divided into two parts of the first divided sheet guide plate 82 and the second divided sheet guide plate 83, an area occupied by the first divided sheet guide plate 82 in the draw-out can be reduced from that in a conventional device. Moreover, since the weight of the first divided sheet guide plate 82 is smaller than that in the conventional device, load for drawing out the first divided sheet guide plate 82 can be reduced.

When the jammed sheet JP is taken out from the inside of the device 70, the user draws out the first divided sheet guide plate 82 of the driven-side sheet guide plate 81 with his/her hand as described above. Moreover, the user can turn, as necessary, the turnable second divided sheet guide plate 83 with his/her hand in an upward direction such that the second divided sheet guide plate 83 is moved away from the drive-side sheet guide plate 71 and the jammed sheet JP, and thereby open the second divided sheet guide plate 83. This allows the user to take out the jammed sheet JP left on the second divided sheet guide plate 83 side more surely.

Assume a situation where the first divided sheet guide plate 82 is drawn out to a position on the front side of the device 70 and the second divided sheet guide plate 83 of the driven-side sheet guide plate 81 is opened upward. When the user erroneously or intentionally pushes the first divided sheet guide plate 82, drawn out to a position on the front side of the device 70, into the device 70 in this situation, the second divided sheet guide plate 83 cannot be housed at a proper position above the drive-side sheet guide plate 71. This causes sheet jamming again or transfer failure of the sheet P to be transferred next.

In view of this, in the first embodiment, measures are taken to prohibit the push-in operation of the first divided sheet guide plate 82 into the device 70 in the state where the second divided sheet guide plate 83 is open. These measures are described by using FIGS. 11A and 11B.

Figure 11A:
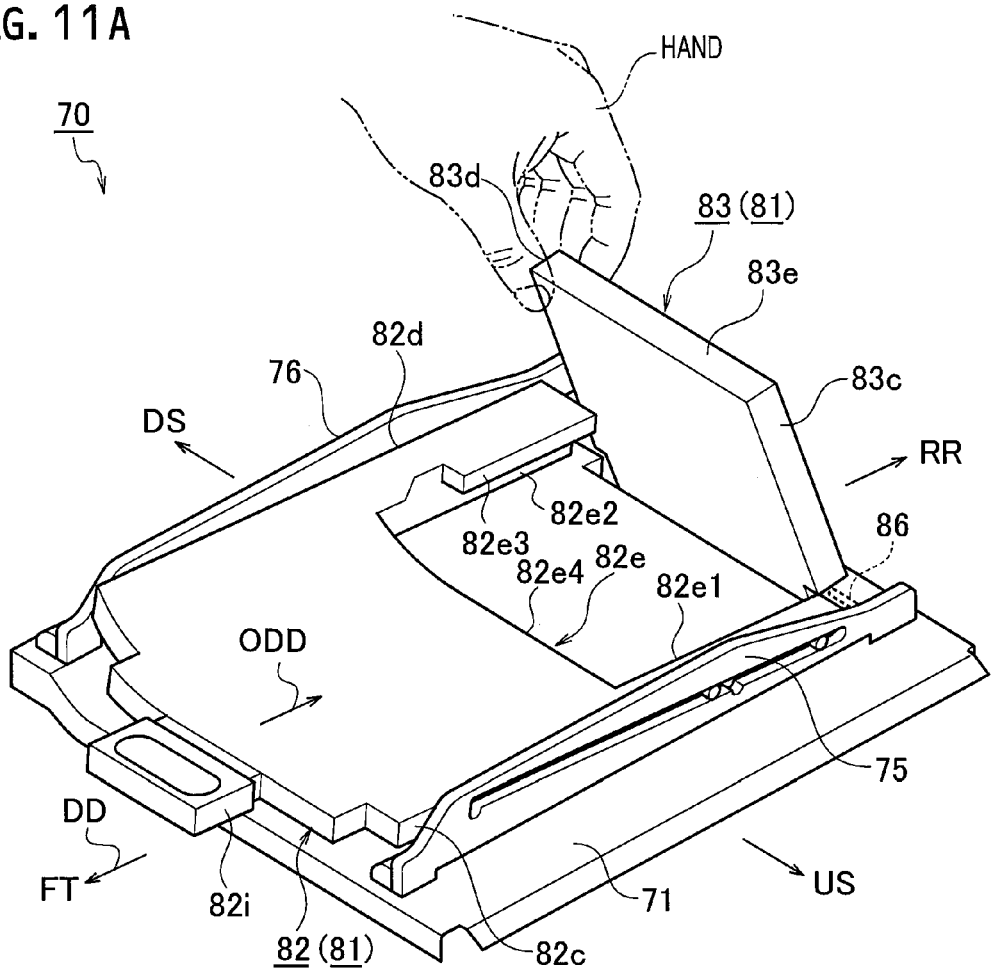
FIG. 11A is a perspective view schematically showing an operation of prohibiting push-in of the first divided sheet guide plate into the device when the first divided sheet guide plate is drawn out to a position on the front side and the second divided sheet guide plate is turned and opened in an upward direction to be moved away from the drive-side sheet transfer guide plate in the sheet transfer device of the first embodiment.
Figure 11B:
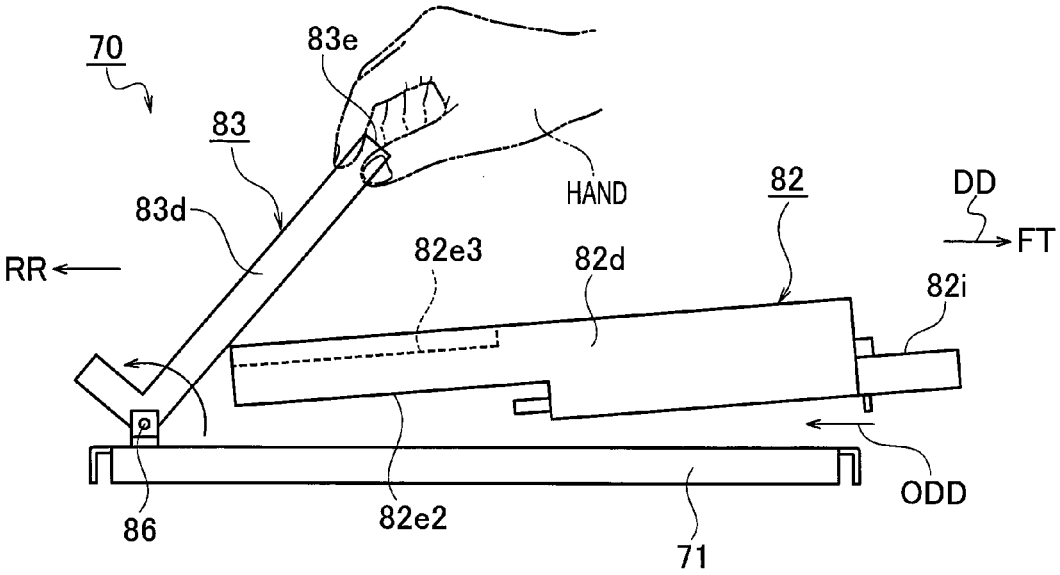
FIG. 11B is a schematic side view of the operation shown in FIG. 11A as viewed from the downstream side.

FIGS. 11A and 11B schematically show an operation of prohibiting the push-in of the first divided sheet guide plate 82, drawn out to a position on the front side, into the device 70 when the first divided sheet guide plate 82 is drawn out to a position on the front side and the second divided sheet guide plate 83 is turned and opened in an upward direction to be moved away from the drive-side sheet guide plate 71.

As shown in FIGS. 11A and 11B, when the user lifts the front surface 83*e* of the second divided sheet guide plate 83 of the driven-side sheet guide plate 81 with one hand while drawing out the first divided sheet guide plate 82 of the driven-side sheet guide plate 81 to a position on the front side with the other hand, the second divided sheet guide plate 83 is turned in the upward direction about the paired turning shafts 86 (only one is illustrated) to be moved away from the drive-side sheet guide plate 71 and the turned state of the second divided sheet guide plate 83 is maintained by the user holding the second divided sheet guide plate 83 with the one hand.

In this case, when the user carelessly or intentionally pushes the first divided sheet guide plate 82 in the opposite direction to the draw-out direction, the upstream and downstream outer surfaces 82*c* and 82*d* of the first divided sheet guide plate 82 are moved toward the rear side along the paired draw-out guide plates 75 and 76.

The push-in prohibiting portion 82*e*3 formed to protrude inward and be connected to the upper portion of the downstream wing portion 82*e*2 out of the upstream and downstream wing portions 82*e*1 and 82*e*2 of the first divided sheet guide plate 82 collides with a portion of the second divided sheet guide plate 83 on the downstream outer surface 83*d* side with the push-in operation of the first divided sheet guide plate 82.

As a result, the operation of the push-in prohibiting portion 82*e*3 formed in the downstream portion of the first divided sheet guide plate 82 can prohibit the push-in operation of the first divided sheet guide plate 82 into the device 70 and, in addition, notify the user that the second divided sheet guide plate 83 cannot be housed into the device 70.

Accordingly, an abnormal state where the second divided sheet guide plate 83 is placed on the first divided sheet guide plate 82 in an overlapping manner does not occur when the first divided sheet guide plate 82 is pushed toward the proper position in the device 70 with the second divided sheet guide plate 83 being open, and the safety and reliability of the device 70 can be improved.

Second Embodiment

Figure 12:
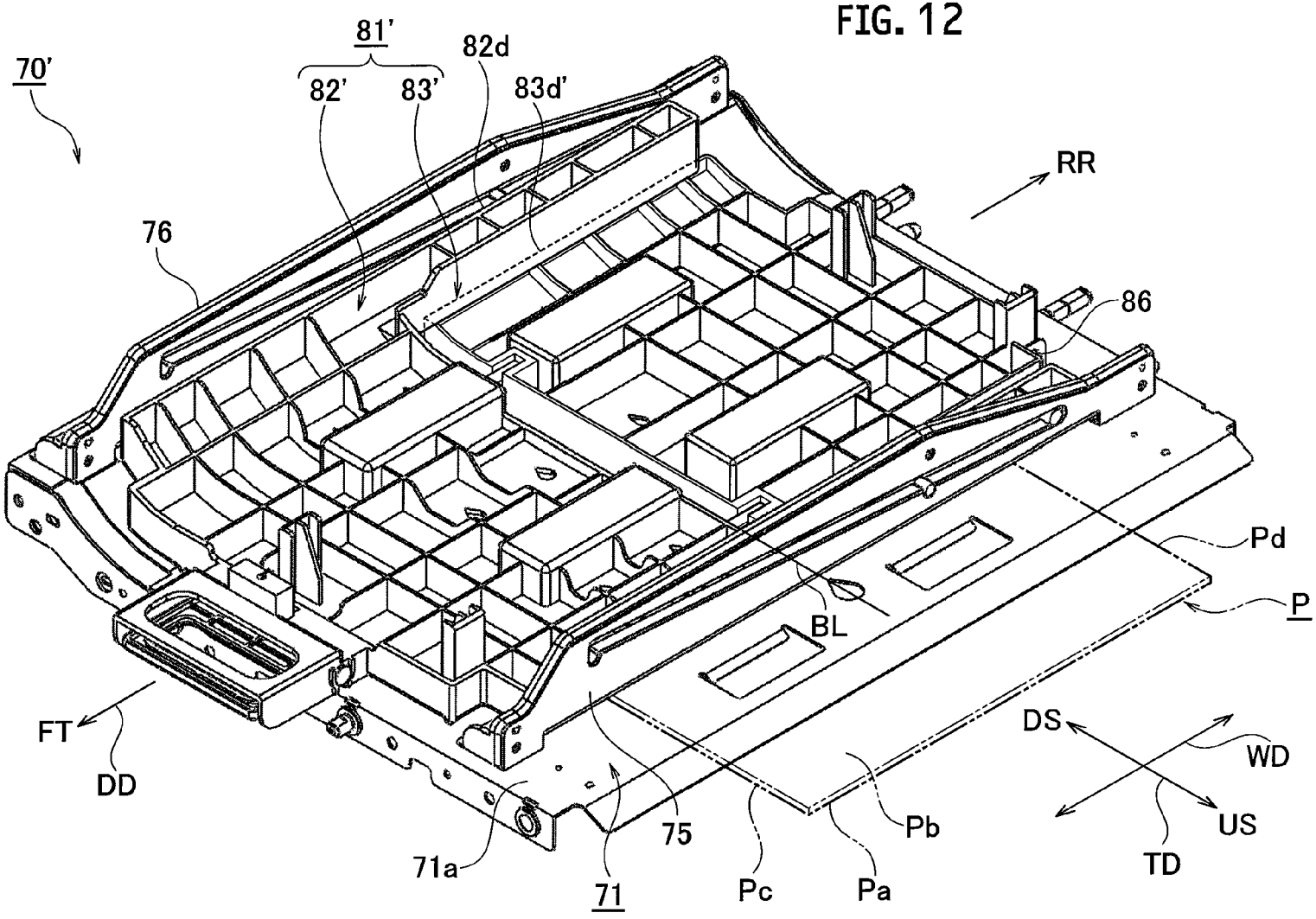
FIG. 12 is a perspective view showing the sheet transfer device of a second embodiment.

FIG. 12 is a perspective view of the sheet transfer device 70' in the second embodiment.

A configuration of the sheet transfer device 70' shown in FIG. 12 is partially different from the configuration of the sheet transfer device 70 (FIGS. 1 and 2) of the first embodiment only in first and second divided sheet guide plates 82' and 83' forming a driven-side sheet transfer guide plate (hereafter, referred to as driven-side sheet guide plate) 81' facing the drive-side sheet transfer guide plate (hereafter, referred to as drive-side sheet guide plate) 71.

In the second embodiment, the same constitutional members and the same shapes as those in the first embodiment are denoted by the same reference numerals, and the aforementioned constitutional members are described as necessary for the sake of convenience of description. Constitutional members different from those in the first embodiment are denoted by new reference numerals and description is given mainly of points different from the first embodiment.

As shown in FIG. 12, the sheet transfer device 70' is also arranged along the sheet transfer route in the inkjet printer 1 as in the first embodiment. For example, the sheet transfer device 70' is unitized and arranged along the horizontal transfer route JR3 in the circulation transfer route JR forming part of the sheet transfer route.

Also in the sheet transfer device 70', above the top surface 71*a* of the drive-side sheet guide plate 71, the first divided sheet guide plate 82' of the driven-side sheet guide plate 81 is attached to be capable of being drawn out to a position on the front side of the device 70', and the second divided sheet guide plate 83' of the driven-side sheet guide plate 81' is turnably attached to a rear side (rear surface side) portion of the device 70'.

Also in the second embodiment, measures are taken to prohibit the push-in operation of the first divided sheet guide plate 82' of the driven-side sheet guide plate 81' into the device 70' when the first divided sheet guide plate 82' of the driven-side sheet guide plate 81' is drawn out to a position on the front side of the device 70' and the second divided sheet guide plate 83' is turned and opened in an upward direction to be moved away from the drive-side sheet guide plate 71. However, the measures are taken by using the driven-side sheet guide plate 81' having a different shape from that of the driven-side sheet guide plate 81 in the first embodiment. The driven-side sheet guide plate 81' is described below by using FIGS. 13 to 16.

Figure 13:
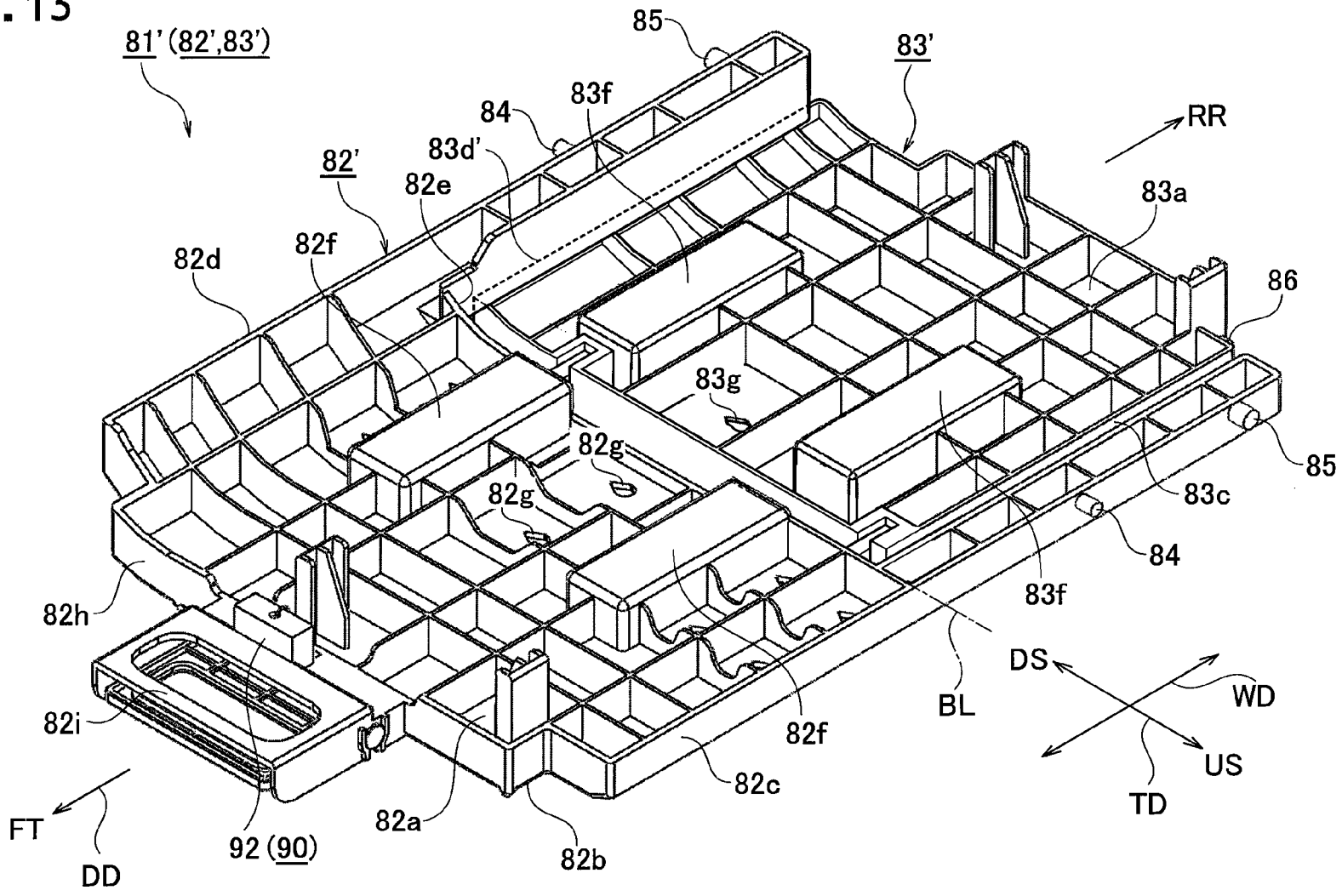
FIG. 13 is a perspective view showing a driven-side sheet transfer guide plate shown in FIG. 12 in the sheet transfer device of the second embodiment.
Figure 14:
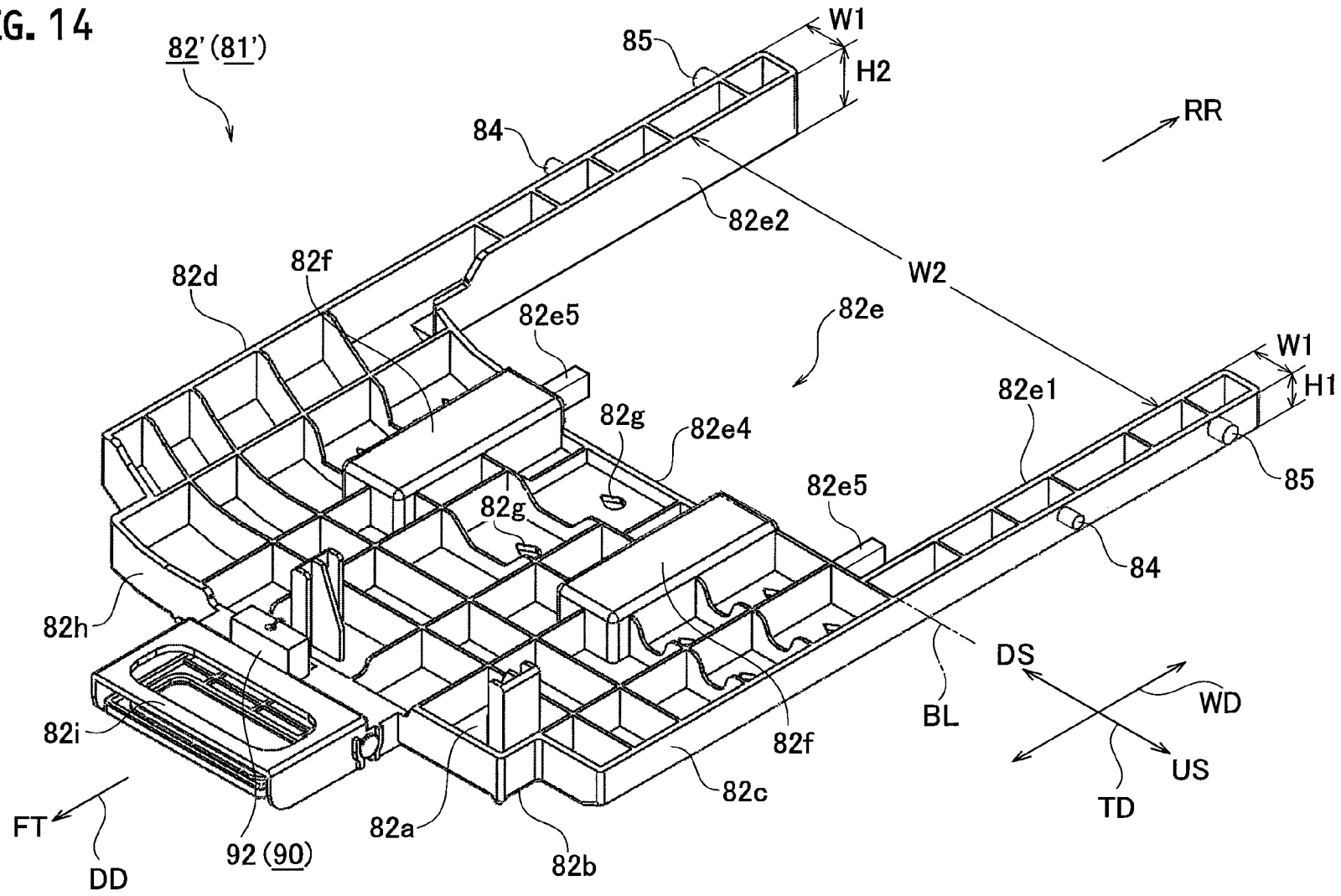
FIG. 14 is a perspective view showing a first divided sheet guide plate of the driven-side sheet transfer guide plate shown in FIGS. 12 and 13 in the sheet transfer device of the second embodiment.
Figure 15:
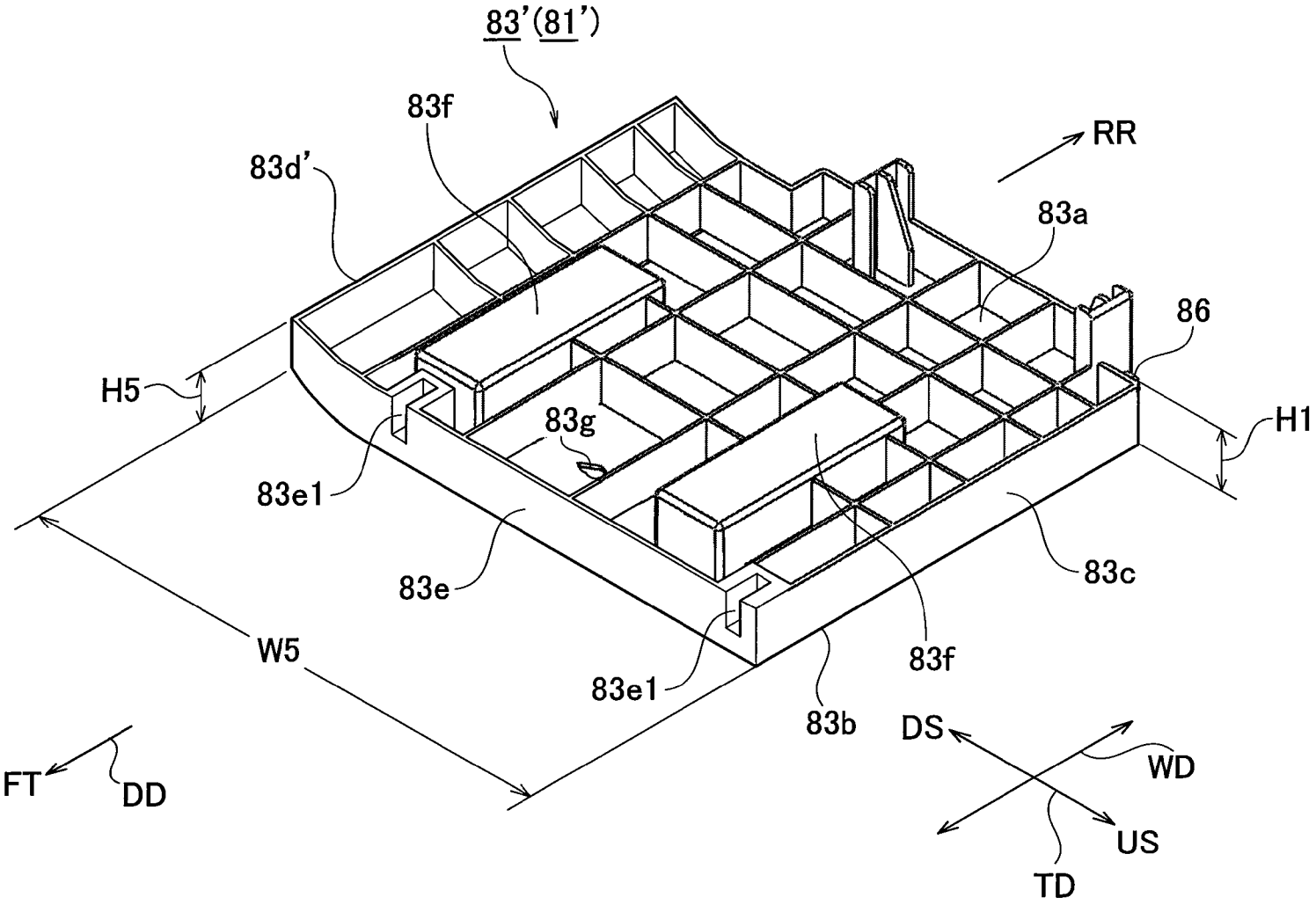
FIG. 15 is a perspective view showing a second divided sheet guide plate of the driven-side sheet transfer guide plate shown in FIGS. 12 and 13 in the sheet transfer device of the second embodiment.
Figure 16:
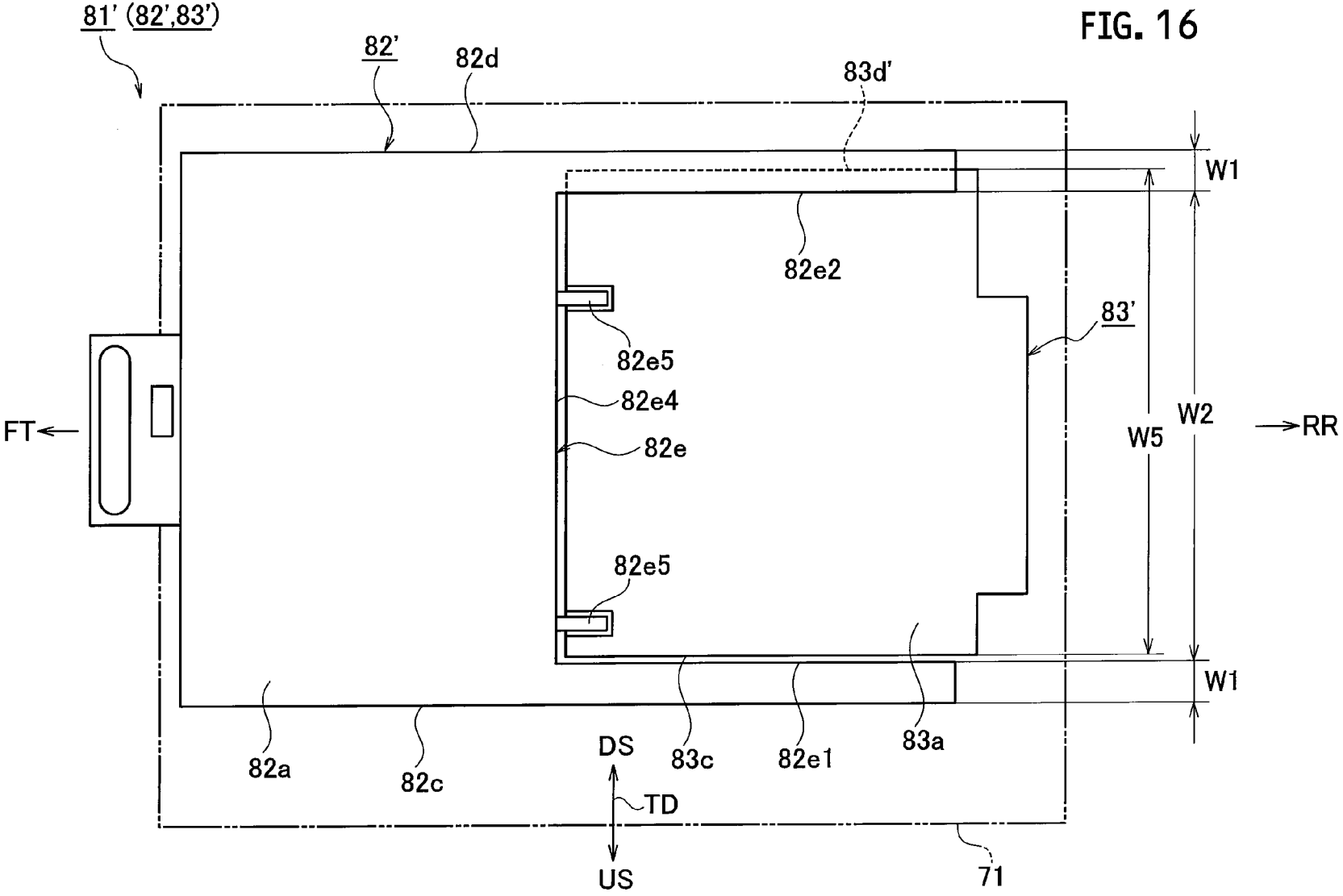
FIG. 16 is a plan view schematically showing a state where a wing portion connected to a downstream outer surface of the first divided sheet guide plate overlaps a downstream outer surface-push-in prohibiting portion of the second divided sheet guide plate in the sheet transfer device of the second embodiment.

FIG. 13 is a perspective view of the driven-side sheet guide plate 81' (82' and 83') shown in FIG. 12. FIG. 14 is a perspective view of the first divided sheet guide plate 82' of the driven-side sheet guide plate 81'. FIG. 15 is a perspective view of the second divided sheet guide plate 83' of the driven-side sheet guide plate 81'. FIG. 16 is a schematic plan view showing a state where the downstream wing portion 82*e*2 of the first divided sheet guide plate 82' overlaps a downstream outer surface-push-in prohibiting portion 83*d'* of the second divided sheet guide plate 83'.

As shown in FIGS. 13 and 14, in the first divided sheet guide plate 82' of the driven-side sheet guide plate 81' which is arranged above the drive-side sheet guide plate 71 in the front side portion of the device 70' (FIGS. 1 and 12), the upstream side and downstream outer surfaces 82*c* and 82*d* extend toward the rear side beyond the dividing line BL and are thus formed to have long dimensions in the sheet width direction as in the first embodiment.

Moreover, inside the outer surfaces 82*c* and 82*d* of the first divided sheet guide plate 82', a portion of the first divided sheet guide plate 82' on the rear side of the dividing line BL is cut away along lines which are parallel to the outer surfaces 82*c* and 82*d* and which are located inside the outer surfaces 82*c* and 82*d* away therefrom in the sheet transfer direction by the narrow width W1, and the rectangular recess 82*e* having a large area is thereby formed as in the first embodiment.

When the first divided sheet guide plate 82' is housed in the device 70', the second divided sheet guide plate 83' on the rear side is located in the rectangular recess 82*e*. However, unlike the first embodiment, the outer surface-push-in prohibiting portion 83*d'* (FIG. 15) formed in the downstream portion of the second divided sheet guide plate 83' protrudes from the inside of the rectangular recess 82*e*.

As described above, when the rectangular recess 82*e* of the first divided sheet guide plate 82' is formed, the two wing portions 82*e*1 and 82*e*2 are formed inside the outer surfaces 82*c* and 82*d* of the first divided sheet guide plate 82'. The wing portions 82*e*1 and 82*e*2 are formed respectively in the upstream portion and the downstream portion of the first divided sheet guide plate 82' at an interval to each have the narrow width of W1 and to extend toward the rear side in an elongated manner.

The width dimension W2 between the inner surfaces of the upstream and downstream wing portions 82*e*1 and 82*e*2 formed along the rectangular recess 82*e* of the first divided sheet guide plate 82' is set to the same dimension as that in the first embodiment. However, unlike the first embodiment, the width dimension W2 is set to be slightly narrower than the width dimension W5 (FIG. 15) between the upstream outer surface 83*c* and the downstream outer surface-push-in prohibiting portion 83*d'* of the second divided sheet guide plate 83' to be described later.

In the first divided sheet guide plate 82' of the second embodiment, no downstream push-in prohibiting portion 82*e*3 (FIG. 5) of the first divided sheet guide plate 82 in the first embodiment is formed, and the downstream outer surface-push-in prohibiting portion 83*d'* (FIG. 15) of the second divided sheet guide plate 83' to be described later has the function of prohibiting the push-in.

When the top surface 71*a* (FIG. 3) of the drive-side sheet guide plate 71 is set as the reference of height, the height H2 of the downstream wing portion 82*e*2 formed along the rectangular recess 82*e* of the first divided sheet guide plate 82' is formed to be higher than the height H1 of the upstream wing portion 82*e*1 and the height H1 (FIG. 15) of the upstream outer surface 83*c* of the second divided sheet guide plate 83', due to the curved shape of the downstream portion of the drive-side sheet guide plate 71 (FIG. 3) as in the first embodiment.

Meanwhile, as shown in FIGS. 13 and 15, the width of the second divided sheet guide plate 83' of the driven-side sheet guide plate 81' arranged above the drive-side sheet guide plate 71 in the rear side portion of the device 70' (FIGS. 1 and 12) is slightly increased from that of the second divided sheet guide plate 83 (FIG. 6) of the first embodiment in the sheet transfer direction in such a way that a portion of the second divided sheet guide plate 83' on the downstream outer surface side is extended in the sheet transfer direction, and the extended portion is formed as the outer surface-push-in prohibiting portion 83*d'*.

As a result, the width dimension W5 between the upstream outer surface 83*c* and the downstream outer surface-push-in prohibiting portion 83*d'* of the second divided sheet guide plate 83' is set to be wider than the width dimension W3 (FIG. 6) between the upstream and downstream outer surfaces 83*c* and the 83*d* of the second divided sheet guide plate 83 in the first embodiment and is also set to be wider than the width dimension W2 (FIG. 14) between the inner surfaces of the upstream and downstream wing portions 82*e*1 and 82*e*2 of the first divided sheet guide plate 82'.

Moreover, the height H5 of the downstream outer surface-push-in prohibiting portion 83*d'* of the second divided sheet guide plate 83' is set to such a value that the outer surface-push-in prohibiting portion 83*d'* can be disposed under the downstream wing portion 82*e*2 of the first divided sheet guide plate 82'.

In the case where the first and second divided sheet guide plates 82' and 83' of the driven-side sheet guide plate 81' are configured as described above, as shown in the plan view of FIG. 16, the downstream wing portion 82*e*2 of the first divided sheet guide plate 82' and the downstream outer surface-push-in prohibiting portion 83*d'* of the second divided sheet guide plate 83' overlap each other in the direction of the gravity when the first divided sheet guide plate 82' is housed in the device 70'. Since the second divided sheet guide plate 83' is housed below the downstream wing portion 82*e*2 of the first divided sheet guide plate 82', the second divided sheet guide plate 83' does not affect at all the draw-out operation and the push-in operation of the first divided sheet guide plate 82'.

Moreover, also in the sheet transfer device 70' configured as described above, when the jammed sheet JP (FIGS. 9A, 9B, 10A, and 10B) is take out from the inside of the device 70', the user draws out the first divided sheet guide plate 82' of the driven-side sheet guide plate 81' with his/her hand as in the first embodiment. Moreover, the user can turn, as necessary, the turnable second divided sheet guide plate 83' with his/her hand in an upward direction such that the second divided sheet guide plate 83' is moved away from the drive-side sheet guide plate 71 and the jammed sheet JP, and thereby open the second divided sheet guide plate 83'. This allows the user to take out the jammed sheet JP left on the second divided sheet guide plate 83' side more surely.

Assume a situation where the first divided sheet guide plate 82' is drawn out to a position on the front side of the device 70' and the second divided sheet guide plate 83' is opened. When the user erroneously or intentionally pushes the first divided sheet guide plate 82', drawn out to a position on the front side of the device 70', into the device 70' in this situation, the second divided sheet guide plate 83' cannot be housed at a proper position above the drive-side sheet guide plate 71. This causes sheet jamming again or transfer failure of the sheet P to be transferred next.

In view of this, also in the second embodiment, measures are taken to prohibit the push-in operation of the first divided sheet guide plate 82' into the device 70' in the state where the second divided sheet guide plate 83' is open. These measures are described by using FIGS. 17A and 17B.

Figure 17A:
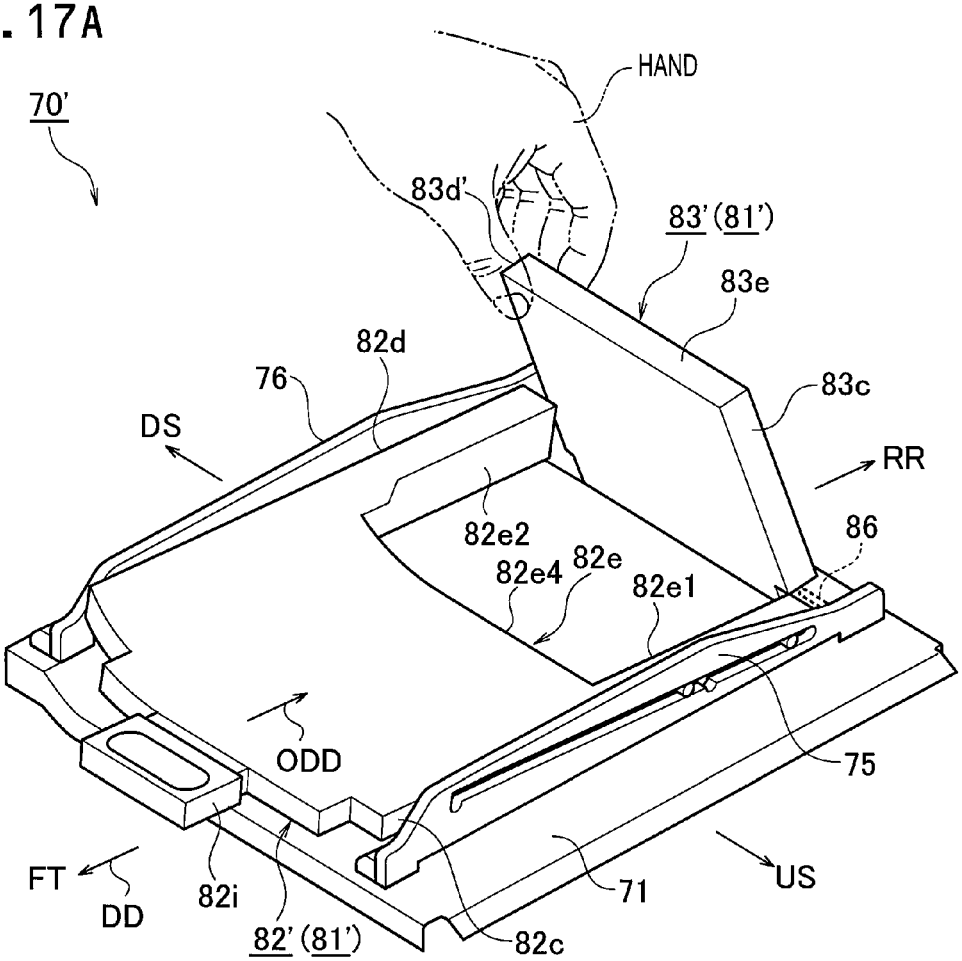
FIG. 17A is a perspective view schematically showing an operation of prohibiting push-in of the first divided sheet guide plate into the device when the first divided sheet guide plate is drawn out to a position on the front side and the second divided sheet guide plate is turned and opened in an upward direction to be moved away from the drive-side sheet transfer guide plate in the sheet transfer device of the second embodiment.
Figure 17B:
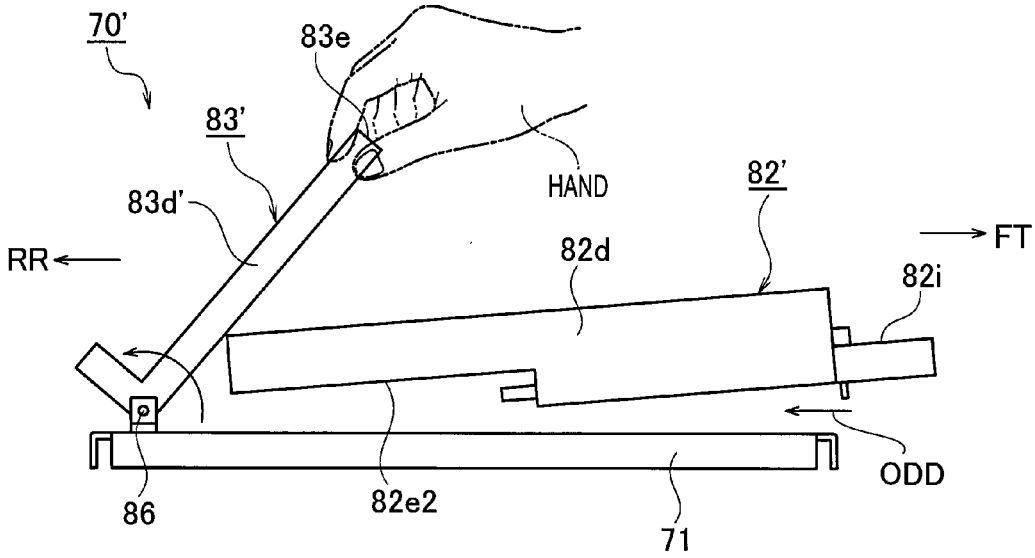
FIG. 17B is a schematic side view of the operation shown in FIG. 17A as viewed from the downstream side.

FIGS. 17A and 17B schematically show an operation of prohibiting the push-in of the first divided sheet guide plate 82' into the device 70' when the first divided sheet guide plate 82' is drawn out to a position on the front side and the second divided sheet guide plate 83' is turned and opened in an upward direction to be moved away from the drive-side sheet guide plate 71.

As shown in FIGS. 17A and 17B, when the user lifts the front surface 83*e* of the second divided sheet guide plate 83' of the driven-side sheet guide plate 81' with one hand while drawing out the first divided sheet guide plate 82' of the driven-side sheet guide plate 81' to a position on the front side with the other hand, the second divided sheet guide plate 83' is turned in the upward direction about the paired turning shafts 86 (only one is illustrated) to be moved away from the drive-side sheet guide plate 71 and the turned state of the second divided sheet guide plate 83' is maintained by the user holding the second divided sheet guide plate 83' with the one hand.

In this case, when the user carelessly or intentionally pushes the first divided sheet guide plate 82' of the driven-side sheet guide plate 81' in the opposite direction to the draw-out direction, the upstream and downstream outer surfaces 82*c* and 82*d* of the first divided sheet guide plate 82' are moved toward the rear side along the paired draw-out guide plates 75 and 76.

The downstream wing portion 82*e*2 out of the upstream and downstream wing portions 82*e*1 and 82*e*2 of the first divided sheet guide plate 82' collides with the downstream outer surface-push-in prohibiting portion 83*d*' of the second divided sheet guide plate 83' with the push-in operation of the first divided sheet guide plate 82'.

As a result, the operation of the outer surface-push-in prohibiting portion 83*d*' formed in the downstream portion of the second divided sheet guide plate 83' can prohibit the push-in operation of the first divided sheet guide plate 82' into the device 70 and, in addition, notify the user that the second divided sheet guide plate 83' cannot be housed into the device 70'.

Accordingly, an abnormal state where the second divided sheet guide plate 83' is placed on the first divided sheet guide plate 82' in an overlapping manner does not occur when the first divided sheet guide plate 82' is pushed toward the proper position in the device 70' with the second divided sheet guide plate 83' being open, and the safety and reliability of the device 70' can be improved.

As described above in detail, in the sheet transfer device 70 (or 70'), when the paired sheet transfer guide plates 71 and 81 (or 71 and 81') are arranged to face each other while each arranged along the sheet transfer route, the sheet transfer guide plate 81 (or 81') out of the paired sheet transfer guide plates 71 and 81 (or 71 and 81') is configured to be dividable into the first divided sheet guide plate 82 (or 82') and the second divided sheet guide plate 83 (or 83').

In this case, the first divided sheet guide plate 82 (or '82) is arranged to be capable of being drawn out in the sheet width direction orthogonal to the sheet transfer direction. Moreover, the second divided sheet guide plate 83 (or 83') is arranged to be turnable in a direction away from the other sheet transfer guide plate 71, about the turning shafts 86 when the first divided sheet guide plate 82 (or '82) is drawn out, the turning shafts 86 arranged parallel to the sheet transfer direction in the rear end on the opposite side to the side toward which the first divided sheet guide plate 82 (or 82') is drawn out.

Furthermore, the push-in prohibiting portion 82*e*3 (or 83*d*') is provided in at least one of the first divided sheet guide plate 82 or the second divided sheet guide plate 83', the push-in prohibiting portion 82*e*3 (or 83*d*') configured to prohibit the push-in operation of the first divided sheet guide plate 82 (or 82') when the first divided sheet guide plate 82 (or 82') is pushed in with the second divided sheet guide plate 83 (or 83') being turned in a direction away from the other transfer sheet guide plate 71. The push-in prohibiting portion 82*e*3 (or 83*d*') is configured such that, when the first divided sheet guide plate 82 (or 82') is pushed in with the second divided sheet guide plate 83 (or 83') not being turned in a direction away from the other sheet transfer guide plate 71, the first divided sheet guide plate 82 overlaps at least part of the second divided sheet guide plate 83 in the direction of gravity.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A sheet transfer device comprising:

a sheet transfer unit including a plurality of pairs of sheet transfer rollers arranged along a sheet transfer route and configured to transfer a sheet in a sheet transfer direction while nipping the sheet between each of the pairs of sheet transfer rollers; and a first sheet transfer guide plate and a second sheet transfer guide plate arranged along the sheet transfer route to face each other and configured to guide the sheet transferred by the sheet transfer unit, wherein the first sheet transfer guide plate includes a first divided sheet guide plate and a second divided sheet guide plate that are separably connected to each other, the first divided sheet guide plate is configured to be drawn out by being movable relative to the second divided sheet guide plate in a sheet width direction orthogonal to the sheet transfer direction, a first portion of the first divided sheet guide plate is configured to overlap a second portion of the second divided sheet guide plate in a direction of gravity, the second divided sheet guide plate with the first divided sheet guide plate drawn out such that the first portion is not overlapping the second portion in the gravity direction, is turnable about a turning shaft in a direction away from the second sheet transfer guide plate, the turning shaft arranged parallel to the sheet transfer direction and arranged in a rear end of the second divided sheet guide plate, the rear end located opposite to a side toward which the first divided sheet guide plate is drawn out, and when the first portion overlaps the second portion in the direction of gravity, the second divided sheet guide plate is prevented from turning about the turning shaft in the direction away from the second sheet transfer guide plate.

2. The sheet transfer device according to claim 1, wherein the first divided sheet guide plate includes a push-in prohibiting portion configured to prohibit a push-in operation of the first divided sheet guide plate with the second divided sheet guide plate turned in the direction away from the second sheet transfer guide plate, and the push-in prohibiting portion overlaps at least a part of the second divided sheet guide plate in the direction of gravity upon the first divided sheet guide plate being pushed with the second divided sheet guide plate not turned in the direction away from the second sheet transfer guide plate.

3. The sheet transfer device according to claim 1, wherein the second divided sheet guide plate includes a push-in prohibiting portion configured to prohibit a push-in operation of the first divided sheet guide plate with the second divided sheet guide plate turned in the direction away from the second sheet transfer guide plate, and the push-in prohibiting portion overlaps at least a part of the first divided sheet guide plate in the direction of gravity upon the first divided sheet guide plate being pushed with the second divided sheet guide plate not turned in the direction away from the second sheet transfer guide plate.

4. The sheet transfer device according to claim 1, wherein the first portion is a pin protruding from the first divided sheet guide plate to the second divided sheet guide plate, and the second portion is a recess for housing the pin in the recess.

5. The sheet transfer device according to claim 1, wherein the second sheet transfer guide plate includes a guide groove along which the first divided sheet guide plate is drawn out in the sheet width direction.

* * * * *